United States Patent [19]

Heisler

[11] Patent Number: 4,601,160

[45] Date of Patent: Jul. 22, 1986

[54] COVER SEPARATING, FEEDING, PLACING AND METERING APPARATUS

[76] Inventor: Raymond A. Heisler, 657 Dakota Trail, Franklin Lakes, N.J. 07417

[21] Appl. No.: 709,897

[22] Filed: Mar. 8, 1985

[51] Int. Cl.[4] ..... B65B 7/28; B67B 3/062

[52] U.S. Cl. ..... 53/485; 53/316; 193/47; 221/297

[58] Field of Search ..... 53/316, 485, 315, 487, 53/314, 313, 367, 368; 493/36; 193/44, 45, 47; 221/241, 242, 211, 297, 301

[56] References Cited

U.S. PATENT DOCUMENTS

| | | | |
|---|---|---|---|
| 1,158,045 | 10/1915 | Graham | 221/297 X |
| 1,680,238 | 8/1928 | Baker | 221/297 X |
| 2,309,568 | 1/1943 | Bell | 221/297 X |
| 2,351,764 | 7/1944 | Bell | 53/313 X |
| 2,669,377 | 2/1954 | Van Poolen et al. | 53/367 X |
| 3,092,941 | 6/1963 | Baker et al. | 53/314 X |
| 3,511,025 | 5/1970 | Newport | 53/307 |
| 3,628,307 | 12/1971 | Croasdale et al. | 53/307 X |
| 3,656,605 | 4/1972 | Gess | 193/44 X |
| 4,072,090 | 2/1978 | Heisler | 493/36 |
| 4,098,059 | 7/1978 | Chattillion | 53/367 X |

*Primary Examiner*—Horace M. Culver
*Attorney, Agent, or Firm*—Ralph R. Roberts

[57] ABSTRACT

This invention shows two mechanisms for receiving, separating, delivering covers to a gravity chute, and thence to metering and cover-positioning and -pressing means. The feeding of covers may be automatic or may be hand-loaded. One embodiment shows the separation mechanism employing Y-members that are actuated by a reciprocated ring with jaws and guide supports in a common plane. Adjusting means for size and cover thickness, both metal and plastic, is contemplated. The other mechanism utilizes jaw arms that are stacked one above the other and preferably are arranged as four pairs, with upper arm jaws moved by one cycled ring and the lower arm jaws moved by another cycled ring. Vacuum cups remove and carry the removed cover to a gravity chute and a metering and cover-pressing apparatus that provides insured placement of only the forwardmost cover on a traveling container. Orienting means is also contemplated, and plural delivery chutes are shown. A height-adjusting means is also depicted.

61 Claims, 43 Drawing Figures

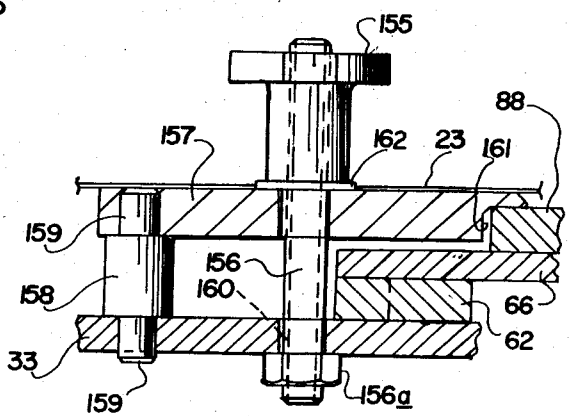
Fig. 9A
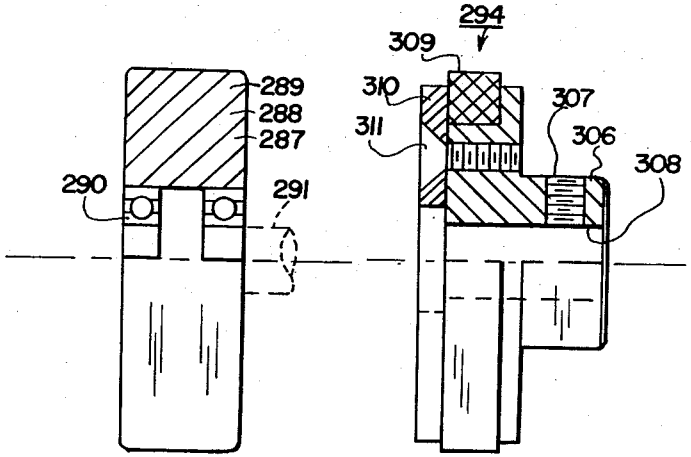
Fig. 16C
Fig. 16D
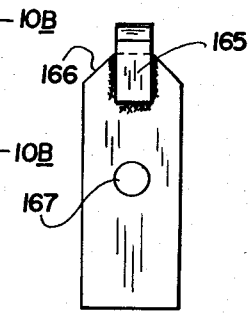
Fig. 10B
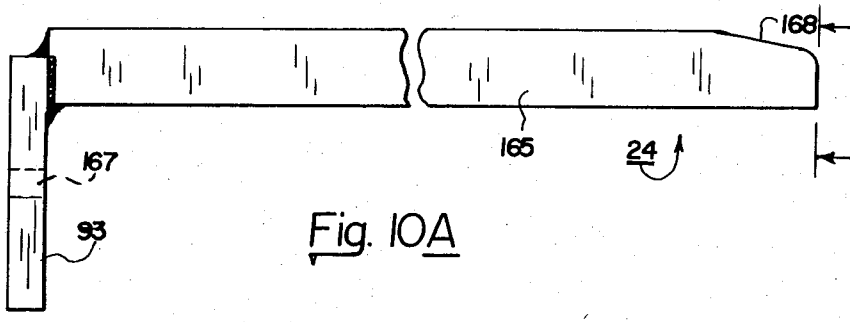
Fig. 10A
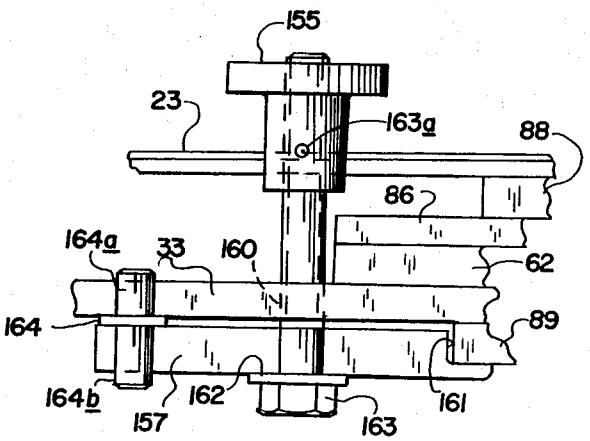
Fig. 9B
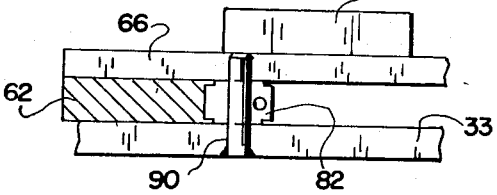
Fig. 5A

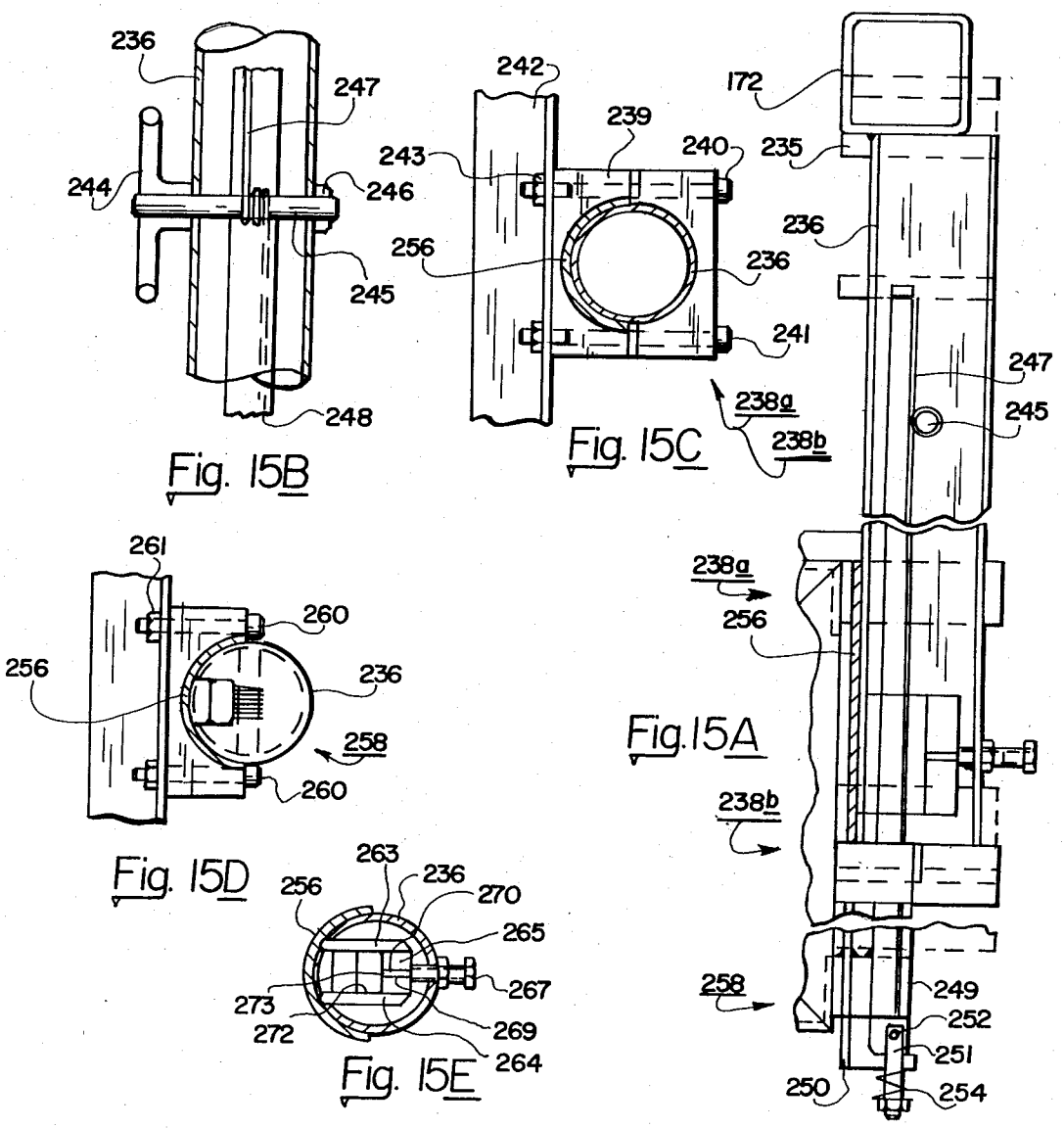
Fig. 15A
Fig. 15B
Fig. 15C
Fig. 15D
Fig. 15E
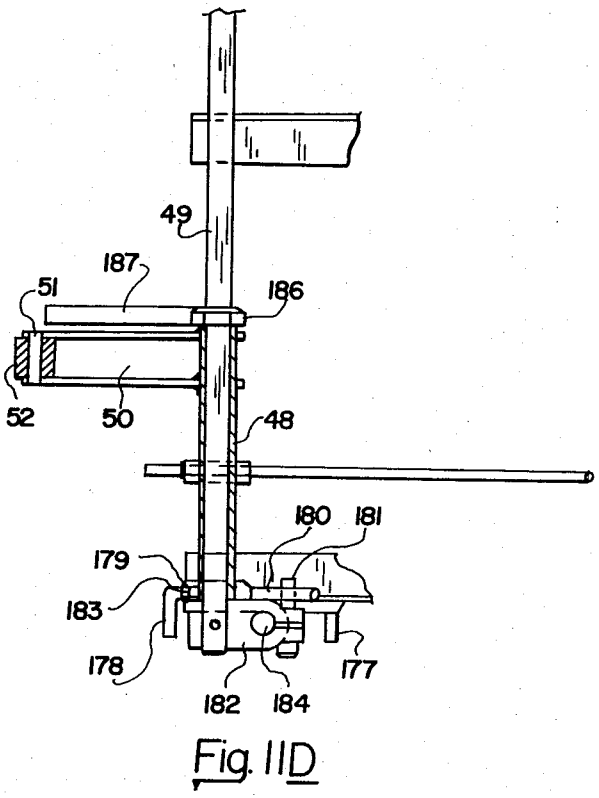
Fig. 11D

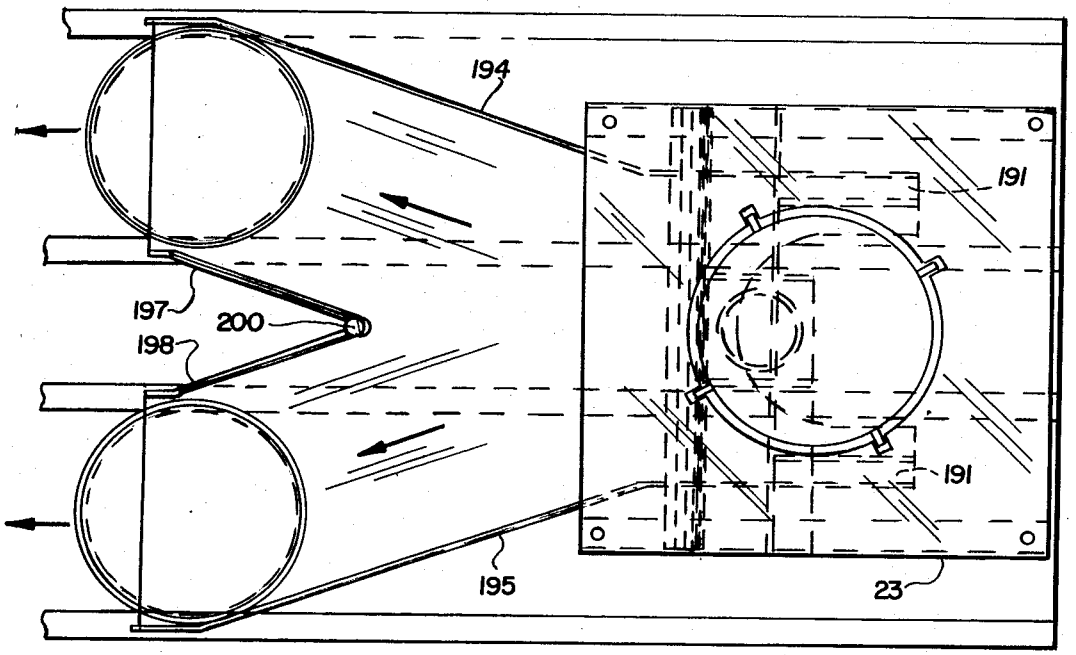
Fig. 12B
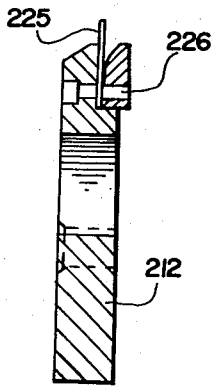
Fig. 14G
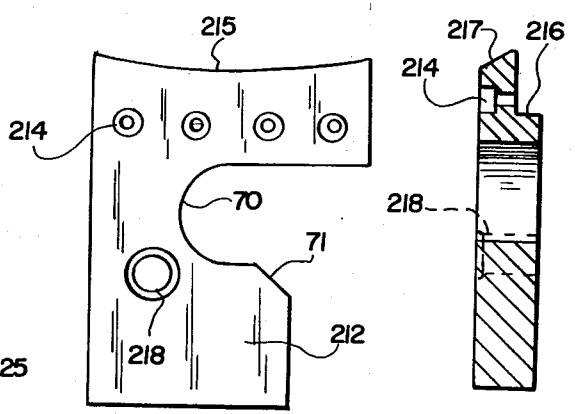
Fig. 14B
Fig. 14A
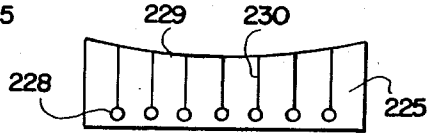
Fig. 14E
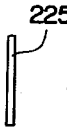
Fig. 14F
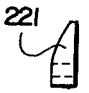
Fig. 14D
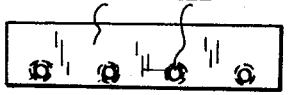
Fig. 14C

COVER SEPARATING, FEEDING, PLACING AND METERING APPARATUS

BACKGROUND OF THE INVENTION

1. Field of the Invention

With respect to the classification of art as established by and in the United States Patent Office, this invention is believed to be found in the general class entitled "Article Dispensing" (Class 221) and subclasses therein pertaining to mechanical release; with pivoted and plural controllers.

2. Description of the Prior Art

A careful pre-Ex search was made in the art, and dispensing, using alternately-moved fingers, is quite well known and used. This art is particularly prevalent with lids for small plastic cups and also for stacked containers having a small taper for nesting together to reduce volume. Reciprocating and vertically-arrayed fingers disposed to engage and feed stacked articles is shown in U.S. Pat. No. 2,870,937 to TELLY. In BRUBAKER, U.S. Pat. No. 2,954,900, is also shown a cap-feeding and alternate finger actuation as well as a vacuum cup withdrawal. BELL, in U.S. Pat. No. 2,352,764, employs a pivoted yoke and finger members actuated therewith. Many like devices and apparatus are shown and have been used, but mostly for a lid-placing apparatus, and particularly where the cap is made within a very close tolerance. As far as is known, this prior apparatus provides a lid or cover dispenser and placing device for one particular situation and/or size. The present invention as disclosed provides and contemplates the separation, dispensing and metering of large covers for large filled containers such as five-gallon containers. The apparatus of this invention not only accommodates metal and plastic covers, but insures that each cover is metered to insure that only one cover is placed and pressed in place on a filled container.

SUMMARY OF THE INVENTION

This invention may be summarized, at least in part, with reference to its objects. It is an object of this invention to provide, and it does provide, a novel and improved apparatus for removing the lowermost cover from a stack and, on a gravity chute, advance this cover to a placing and affixing station which also automatically actuates a metering means.

It is a further object to provide, and it does provide, apparatus in which a stack of metal or plastic covers for a large filled container, such as a five-gallon pail, is provided with a separated, advanced, metered and positioned cover. This separating apparatus utilizes a plurality of pairs of fingers actuated by a ring member moved by a pneumatic cylinder. A gravity chute is disposed to receive this separated cover and advance this cover to metering and placement apparatus.

In brief, this apparatus includes guide means that is adjusted to accommodate size variations in large covers, either metal or plastic. A plurality of finger pairs (usually four) are actuated by an outer ring moved by a pneumatic cylinder. This ring when actuated causes a "Y" member associated with each finger pair to be actuated to move in and out of said finger pairs and provide desired separation. Moved in timed concert with the release of a cover is a vacuum cup means that engages the lower-most cover and brings this cover to a sloped chute where the cover is released to move by gravity to a metering and placement station. This station has apparatus for preventing the "shingling" of one cover with another and insure that only one cover is mated, placed and partially mounted on an advancing pail.

Alternate means or apparatus are depicted and a description thereof is provided both for covers with spouts and for apparatus adapted for a wide range of cover sizes. Covers with spout or nozzle means are often utilized with contents that are fluid or semi-fluid and such containers are usually provided with a spout or nozzle means. Apparatus for covers with spouts or nozzle orientation is provided with separating, orienting and feeding means. The delivery chute is provided with an orienting station that precisely positions the spout in relation to the side of the container so as to present a label surface in a particular position. Bailed containers are also contemplated for use with covers with nozzle means. There is also shown and described alternate apparatus for accommodating typical covers as small as six inches in diameter and as great as more than twelve inches diameter. These sizes are only typical and are not suggested as limiting.

In addition to the above summary, the following disclosure is detailed to insure adequacy and aid in understanding of the invention. This disclosure, however, is not intended to cover each new inventive concept no matter how it may later be disguised by variations in form or additions of further improvements. For this reason, there has been chosen a specific embodiment of apparatus for cover separation, feeding, placing and metering of said covers. This apparatus is adopted for use with both metal and plastic covers and showing a preferred means for mounting said covers on larger pails. Single and plural placement guide means are provided. This specific embodiment has been chosen for the purposes of illustration and description as shown in the accompanying drawings wherein:

BRIEF DESCRIPTION OF THE DRAWINGS

FIG. 5A represents a diagrammatic, partly sectional and very fragmentary view showing a cam-follower bearing and pin support, the bearing providing a precise spacing of the support plate and above ring plate;

FIGS. 8A, 8B and 8C represent the contour and construction of the jaw members used for the lower escapement jaw and for the upper clamp jaw with a removable face for a metal cover and alternately constructed for a plastic cover;

FIGS. 9A and 9B represent fragmentary side, diagrammatic views, partly in section, showing clamp apparatus, one clamp for the lower escapement ring and one clamp for the upper clamp ring;

FIGS. 10A and 10B represent side and plan views showing the preferred construction of cover guides;

FIGS. 11A, 11B, 11C and 11D represent side, plan and end views of the guide chute and the metering apparatus as well as the cover-pressing roller apparatus and spring means disposed to urge the cover into position;

FIGS. 12A and 12B represent plan views, very diagrammatic, and showing means for plural delivery of covers after dispensing of the covers onto a gravity chute;

FIGS. 14A, 14B, 14C, 14D, 14E, 14F and 14G represent plan, side, end and assembly views of an alternate jaw construction for releasing the scallops of a metal cover from the apertures in stacked covers;

FIGS. 15A, 15B, 15C, 15D and 15E represent diagrammatic views of apparatus for height adjustment of the dispensing apparatus;

FIGS. 16A, 16B, 16C, 16D and 16E represent diagrammatic views and showing of apparatus for orienting covers having nozzle or spout portions of the cover.

In the following description and in the claims, various details are identified by specific names for convenience. These names are intended to be generic in their application. Corresponding reference characters refer to like members throughout the several figures of the drawings.

The drawings accompanying, and forming part of, this specification disclose details of construction for the purpose of explanation, but structural details may be modified without departing from the concept and principles of the invention and the invention may be incorporated in other structural forms than shown.

EMBODIMENT OF FIG. 1

Figure 1:
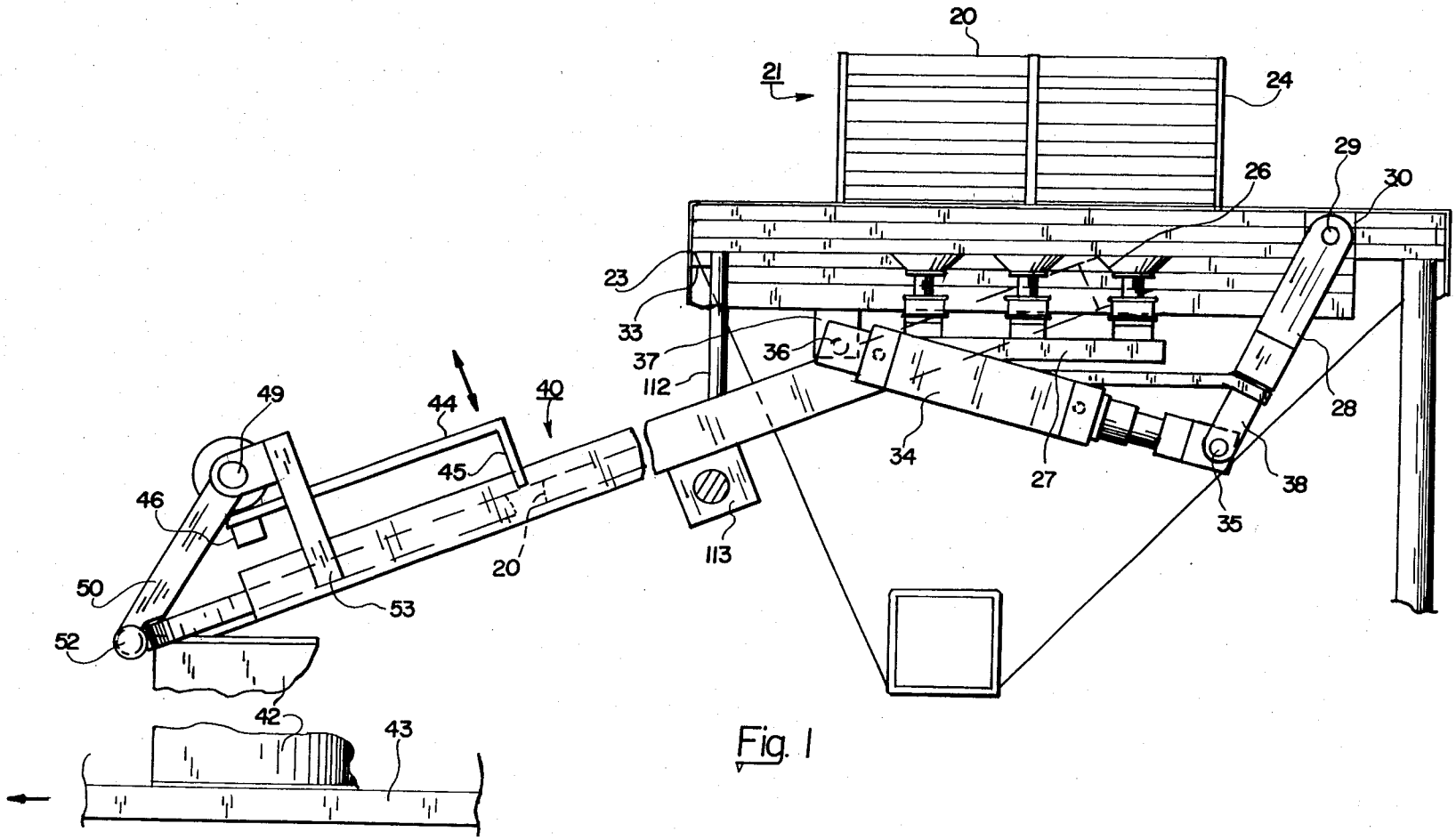
FIG. 1 represents a side view, partly diagrammatic and partly in section, and showing the arrangement for accommodating a stack of lids or covers and, by metering means and vacuum cups, remove one cover at a time and deliver said cover to a gravity guideway having spacing means to insure delivery, positioning and mounting means.
Figure 13:
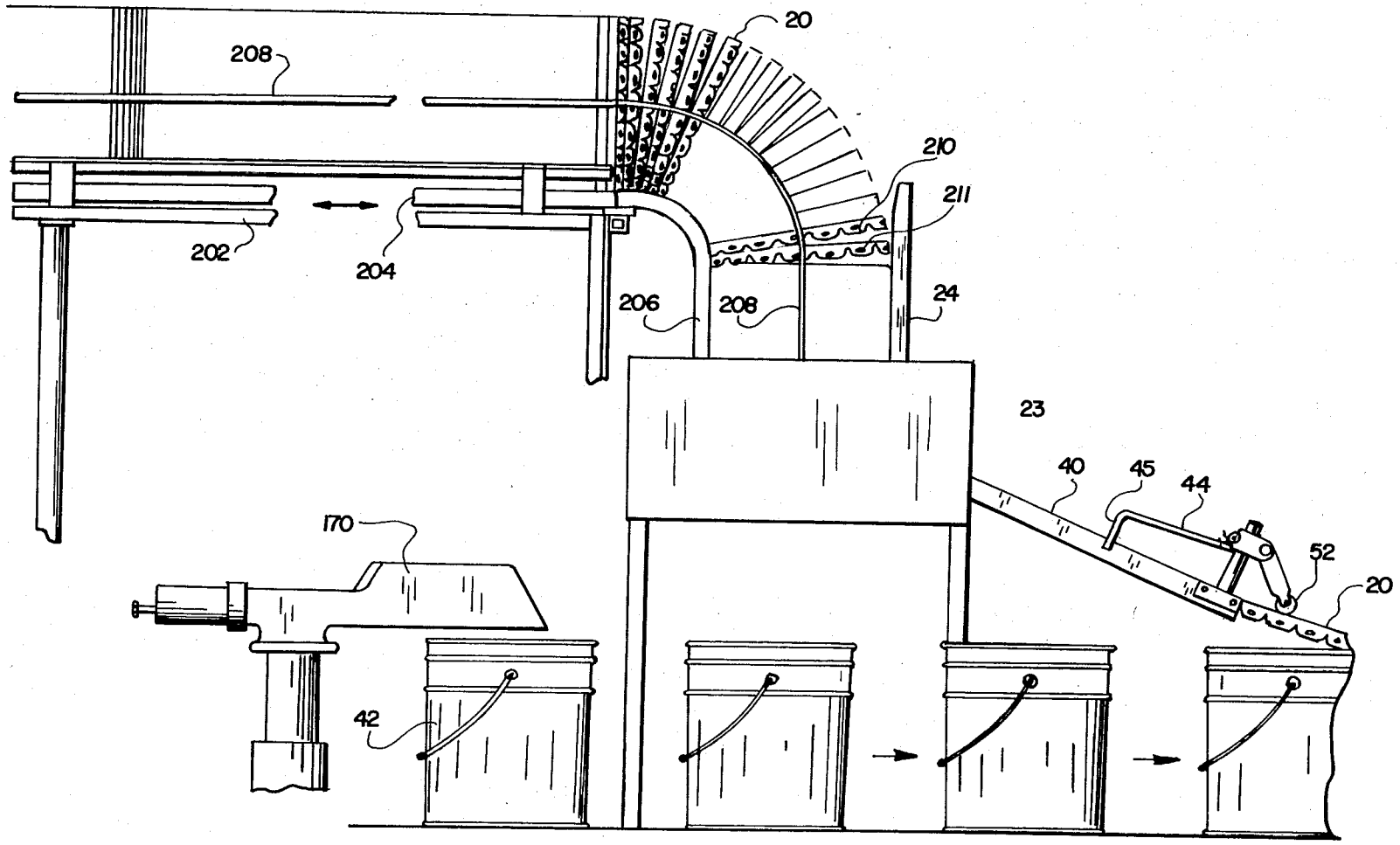
FIG. 13 represents a side view, partly diagrammatic, of an automatic supplying of covers to the separating and dispensing apparatus.

In FIG. 1 it is to be noted that this showing is very diagrammatic so as to illustrate the relative positioning of the several essential components. This apparatus provides for the feeding, one at a time, of covers or lids 20 from a generally vertical stack identified as 21. These covers are contemplated as being delivered to the stack by one of two procedures. The replenishing of covers 20 may be by manual means in which condition guides for the stack may be as much as eighteen inches high, or by automatic feeding means such as a walking-beam feed similar to that shown in my U.S. Pat. No. 4,072,090, as issued Feb. 7, 1978, employing FIGS. 2 through 6. This apparatus is modified to provide such delivery means (FIG. 13). Above a housing 23, guide members 24 are shown. There are at least three, and preferably four, guide members. When the replenishing of covers is by manual means as noted above, the guide members are about eighteen inches in height whereas when the replenishing is by an automatic feed, the guide members are about eight inches in height.

These covers 20, because of their outer edge configuration, have a tendency to become stuck together. This stack is presented to apparatus for positive separation. This cover separation will be discussed in detail hereinafter. A plurality of vacuum cups 26, usually four, are generally equally spaced and the top open cup portions are disposed in generally a common plane so as to contact the bottom surface of the lowermost cover with substantially the same pressure. As shown in detail in FIG. 4, these cups are carried by and on a plate member 27 carried on an arm 28. This arm is carried by a shaft 29 carried in a bearing block 30. This block is depicted as having threaded apertures 31 (FIG. 4) which are engaged by cap screws or bolts 32 to a support plate 33. This is a fabricated or constructed arm which is swung in an arc by a pneumatic cylinder 34 pivotally connected by a pin 35 at one end and having the other end of the cylinder pivotally carried by a pin 36 in a fixed support 37, also fixedly attached to the non-moving plate support portion 33 of this apparatus. It is noted that arm 28 is a fabricated assembly having a downwardly extending portion 38 adapted to pivotally carry pin 35. This end 38 and the rod end of cylinder 34 are conventionally connected in and with a clevis connection. Also seen partially in section in this view is the outer housing 23 which is usually of sheet metal and provides protection to accidental exposure of moving components.

The vacuum cups 26 are connected to a source of vacuum and have control means, not shown, so that vacuum is applied to the cups when and while the lowermost cover 20 is being withdrawn and they are swung in an arc downwardly until the cover comes in way of a guideway 40 which may be angles or a sheet-metal chute. This guideway is disposed at a given angle sufficient to advance these withdrawn covers by gravity to meet with filled containers or can 42 carried and advanced by a conveyor 43. Shown in this view and later in greater detail is a stop and spacing finger 44 that is of a rod-like construction with a down-turned distal and engaging end 45. This rod-like finger is carried in a retainer 46 and on a pivotally-movable sleeve 48 seen in FIG. 11D carried on shaft 49. Also carried on this sleeve is a cover-pressing member 50 which has on its trailing end a roller 52 adapted to engage the forward edge of a cover 20 and press it onto the container 42. This roller is urged into pressing condition by a spring 53 and presses the cover onto the top of the container 42 as it is advanced by the conveyor 43.

EMBODIMENT OF FIG. 2

Figure 2:
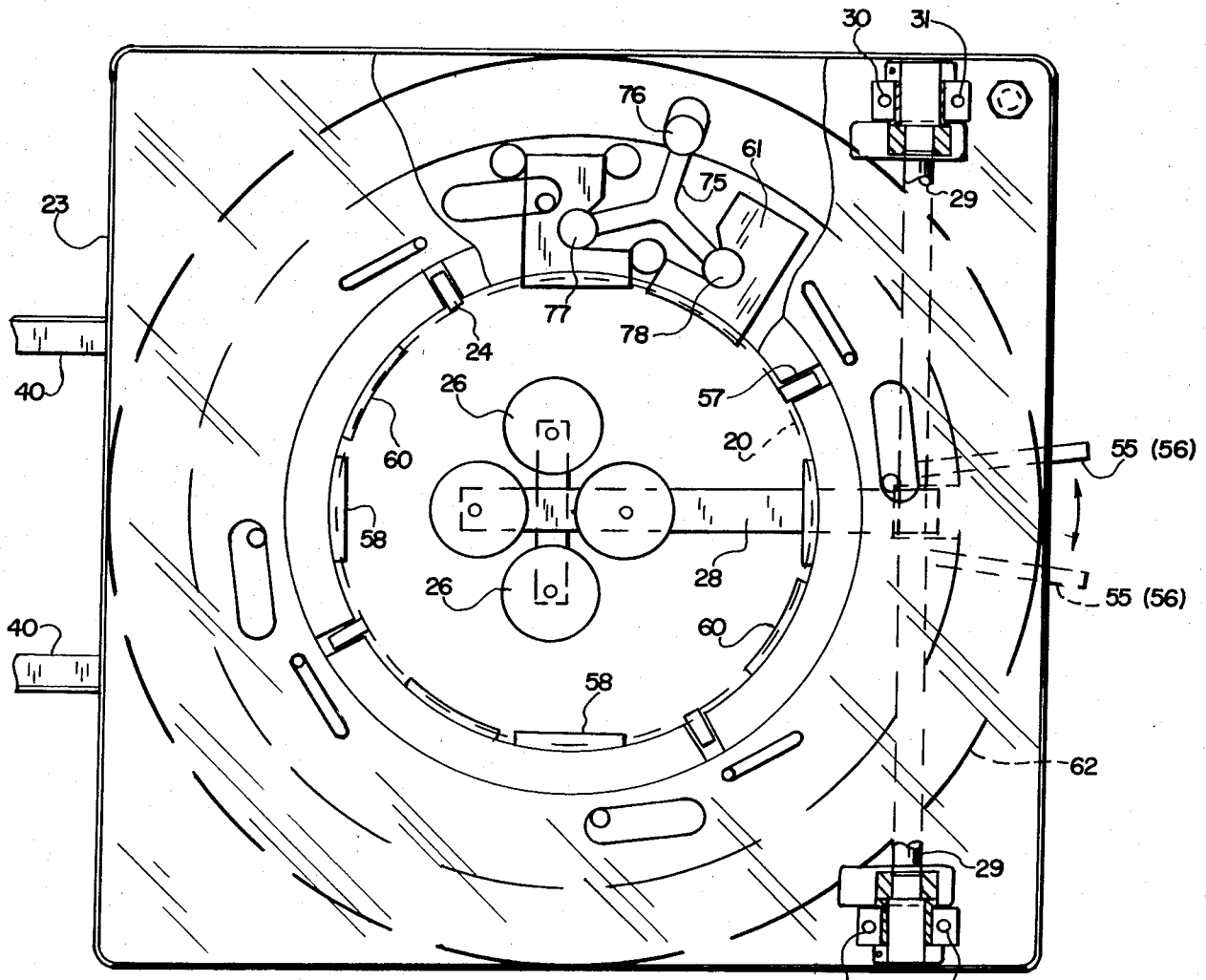
FIG. 2 represents a top or plan view, partly diagrammatic and partly in section, and showing the cover-metering mechanism of FIG. 1 but with the stack of covers removed so as to show the array of essential components.

In FIG. 2 the plan view is partly diagrammatic and fragmentary to illustrate the relationship of components. The housing 23 conceals most of the apparatus for the separation, placement and delivery one at a time of covers 20 from stack 21 (shown in FIG. 1) onto the guideway 40. The metering of these covers is described above and hereinafter. The guide members 24 are each movable in cutouts 57 formed in the housing 23. As depicted, there are four lower jaws 58 which are movable in and out by mechanism hereinafter described. Adjacent each lower jaw 58 is an upper jaw 60 having an arcuate face contour. This upper jaw 60 has the contour face portion attached by screw means to an actuating portion 61 to provide an accommodation for metal (steel) or plastic covers. As shown, there are four vacuum cups 26 carried by arm 28. The guideway 40 for the withdrawn covers 20 is shown as in a straight line discharge as on a center line of the apparatus, but there is also shown guide means for delivering covers to two conveyor lines as shown in later FIGS. The delivery guideway is made to accommodate a customer's requirement and production line.

This spring-actuated member 50 and the associated components will be discussed in detail in conjunction with FIG. 11C. In this view, the distal end 45 of rod-like finger 44 is moved in way of a cover 20 by gravity and is lifted to allow the advancing of a cover in the absence of a filled container or can 42. Roller 52 is urged into pressing condition by the spring 53 and through a lost motion apparatus the rod-like finger is caused to be lowered in way of a next cover 20. This distal stop end 45 remains in position while the roller 52 is lifted by the advancing container and cover. After advancement has been completed, the roller 52 is moved downwardly and distal end 45 is lifted from in way of the following cover 20. It is to be noted that finger 44 is adjustable on and along shaft 49 so as to insure that this end 45 comes in way of and in the spacing between covers.

EMBODIMENT OF FIGS. 3A, 3B, 4, 5, 6 AND 7

Figure 3A:
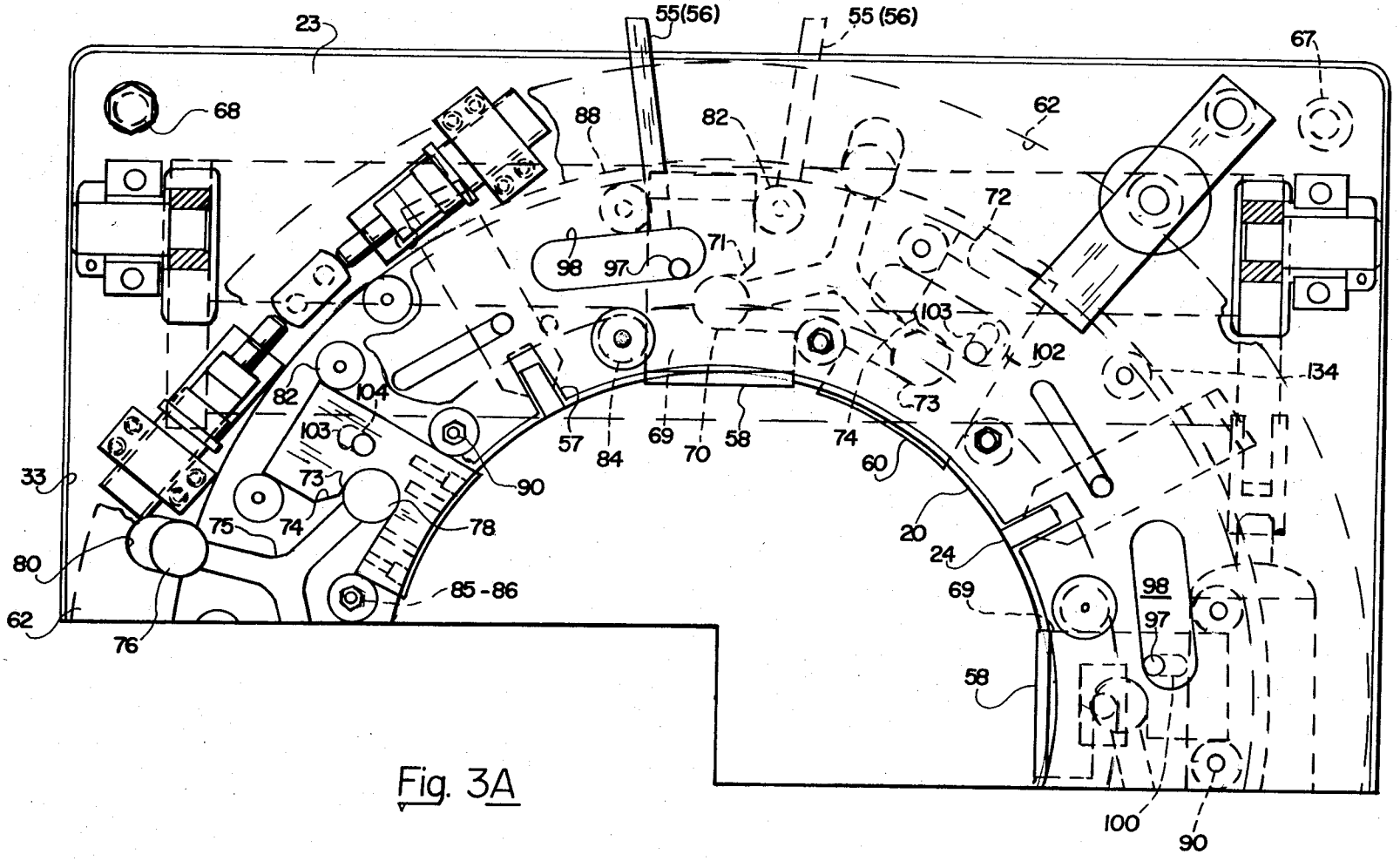
FIGS. 3A and 3B represent plan views, partly diagrammatic and partly in section, on two sheets of drawings and in an enlarged scale to show a plan view of the apparatus of FIG. 2 and the interrelationship of the several components that are employed to stack covers, then separate said covers and, one at a time, dispense a cover to a gravity chute.
Figure 3B:
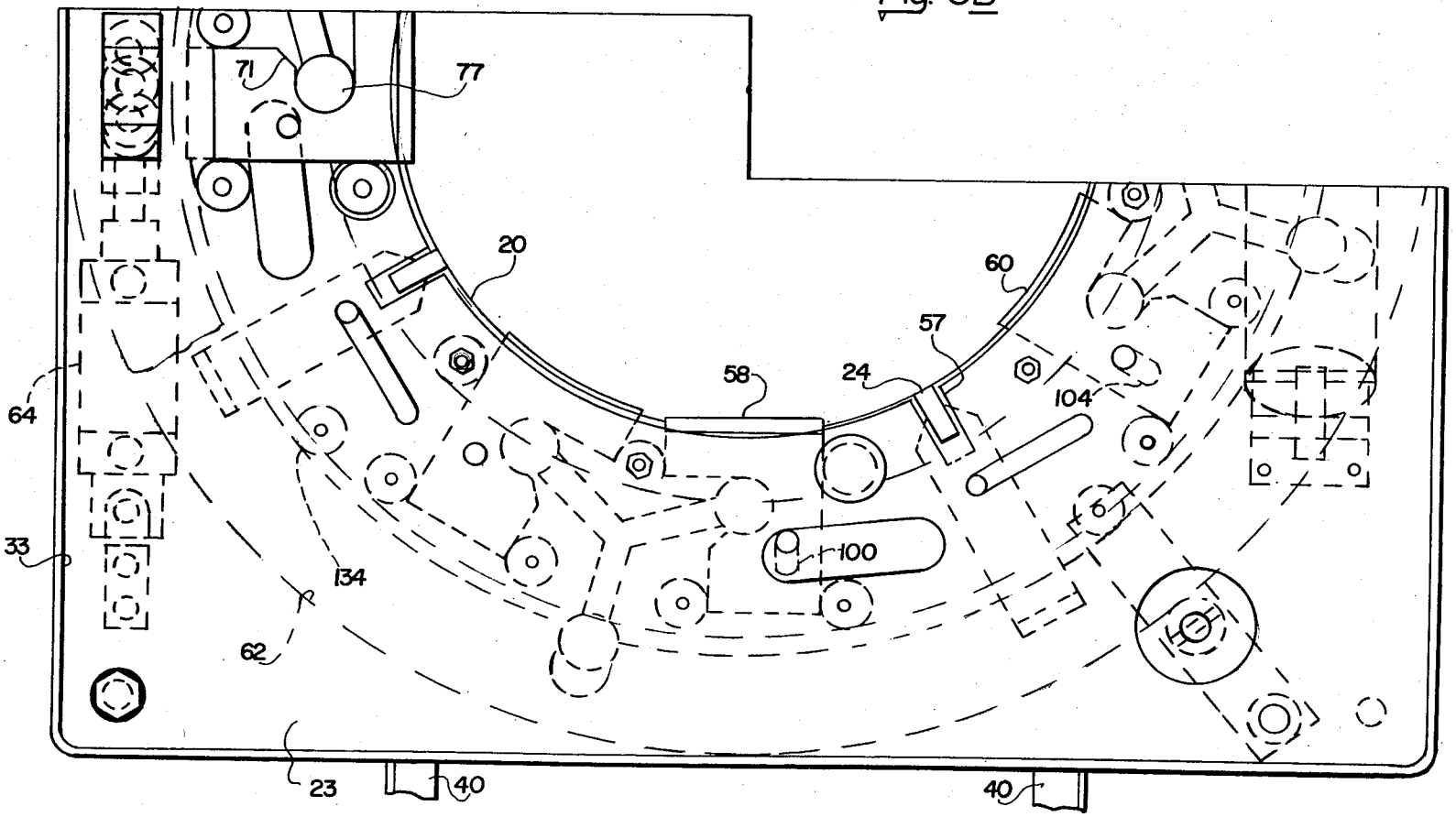

In the following disclosure of the cover separating and dispensing apparatus, the several FIGS. in this group disclose and show the relationship of these components. In FIGS. 3A and 3B these views are partly diagrammatic and show the interrelation of the several components. These views (FIGS. 3A and 3B) when placed together depict a plan view of the cover separation and discharge apparatus and, except for adjusting levers 55 and 56 which extend from the housing 23, show apparatus within this housing. Omitted from these views are covers 20 shown in FIG. 1.

As shown, the top of the housing 23 is provided with cutouts 57 (four depicted) for the in-and-out limited movement of guide members 24. Also seen are the protruding ends of lower jaw 58 and upper jaw 60. An outer movable ring 62 is moved back and forth by a pneumatic cylinder 64 carried below a supporting (generally square) plate identified as 33. This supporting plate is carried by posts or pipe members 67 and hex-headed cap screws or bolts 68 at the four corners thereof. These cap screws not only retain the housing 23, but also the components therein. Jaws 58, which are the lower jaws, have an outwardly-extending body portion 69 in which a circular pocket 70 is formed and from this pocket and to one side of said pocket is formed a relief cutout 71. Jaw 60 has its forward or inwardly-extending end formed with an arc which is substantially the contour and diameter of the cover 20 to be accommodated. The cover 20 may be metal or may be plastic. For metal, the jaw face 60 is provided with a lower lip and contour and, where the cover is plastic, another jaw face is provided. As this change must be accommodated, the jaw 60 has a face portion which is removably secured by cap screws. Jaw configuration is discussed in detail in conjunction with FIGS. 8A B and C. Jaw 60 has its body portion 72 formed with a circular pocket 73 and has a side relief cutout 74 similar to cutout 71 in jaw 58. An upper fixed plate 66 provides a spaced retainer for movement of the jaws 58 and 60 and with the spacing means hereinafter more fully discussed.

There are provided a plurality of Y-members 75 having precisely-sized and -shaped ends 76, 77 and 78. The outer end 76 is sized to enter and be slideable in a slot 80 (four depicted) formed in the movable outer ring 62. In FIGS. 3A and 3B this Y-member 75 is seen in full outline, although in practice these Y-members are below the housing 23. Each lower jaw 58 is guided by four like cam follower-type bearings 82. Like cam follower bearings 82 are utilized to guide and retain each upper jaw 60. It is noted that only one bearing 82 is utilized as a forward guide between and for jaws 58 and 60. It is to be noted that at four spaced positions, upper and lower retaining washers 83 and 84 are retained by a flat-head cap screw 85 and a nut 86. This is particularly shown in FIG. 7 with reference to upper and lower adjusting rings 88 and 89. These are the rings selectively movable by adjusting levers 55 and 56. These cam-follower bearings provide anti-friction means for retaining these upper and lower adjusting rings. It is to be noted in FIG. 5A that these cam follower-type bearings 82 have their inner hub portion of a greater length so as to extend slightly from the outer tire portion. This hub portion provides a determined spacer means utilized throughout this assembly. These bearings 82 are carried on pins 90 secured in holes in the bottom plate 33 and slidably mounted in holes formed in the round plate 66 above.

For limit adjustment of each of the jaws 58 there is provided a pin 97 secured to and mounted in each jaw. This pin extends into a slot 98 formed in the upper ring member 88. It is to be noted in FIG. 7 that each pin 97 has a shoulder 99 which provides a stop for the positioning and securing of the pin. A flat-head cap screw or rivet head is provided to securely retain this pin. Plate 66 is formed with four radial slots 100 (FIG. 3A) to accommodate the movement of pin-enlarged shoulder portion 99 to move in and out as the jaw 58 is moved in and out by ring 62. Although only one slot 100 is depicted, there is a like slot for each jaw 58.

Figure 7:
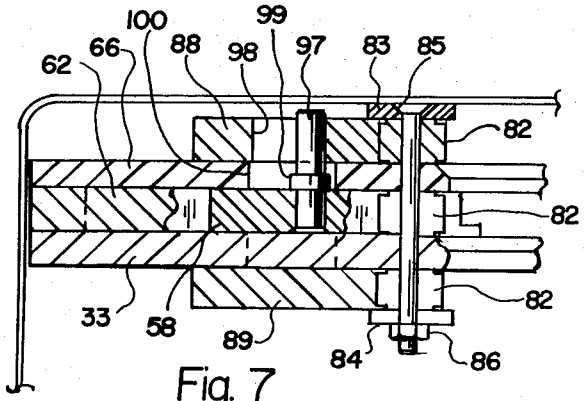
FIG. 7 represents a fragmentary sectional side view showing the relationship of the cam-follower bearings that are used to provide guidance and spacing of the several plate components.

Jaw 60, which is the jaw member which engages the just-above cover 20 (second) to prevent this above cover from also being moved downwardly during dispensing, is adjusted as to positioning by the lower adjusting ring 89 (FIG. 7). This ring is moved by the lever 56 connected thereto. In the bottom adjusting ring 89, there are slots 102, very similar to slots 98, but only in said bottom ring. These slots 102 are disposed for limit adjustment of the jaws 60. A pin 103 extends through the support plate 33 and into the slot 102 formed in the lower adjusting ring 89. Pin 103 is identical or very similar to pin 97 in that a stop shoulder is provided and the support plate 33 is provided with radial slots 104 for the in-and-out movement of pin 103. The limit adjustment of jaw 60 and the apparatus associated with ring 89 is like that for jaws 58 described above.

Figure 4:
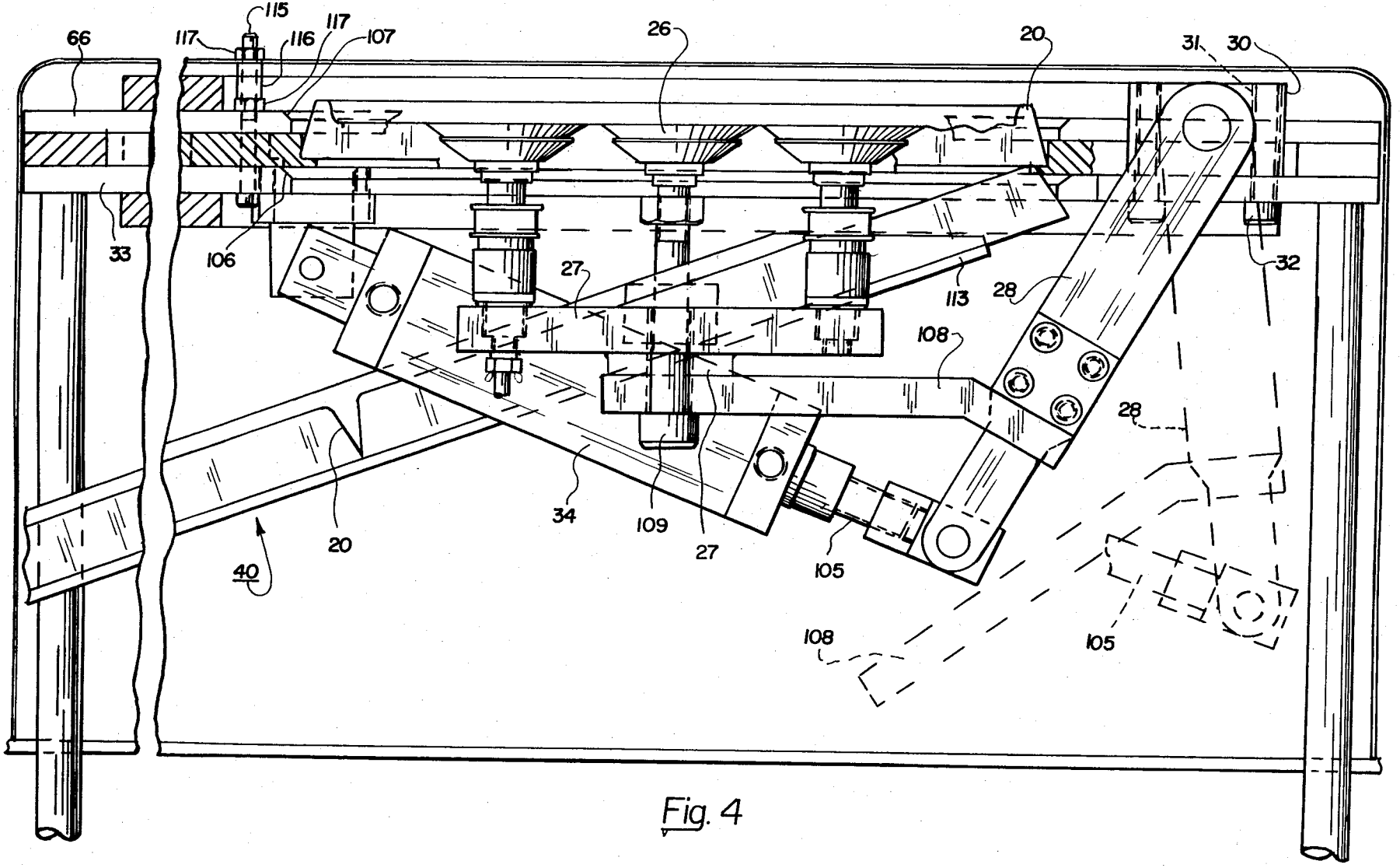
FIG. 4 represents a side view, in a slightly enlarged scale from that of FIGS. 3A and 3B, this view partly diagrammatic so as to illustrate means and apparatus for grasping the lowermost cover by a plurality of vacuum cups and deliver said cover to and onto a gravity chute.

In the side view particularly shown in FIG. 4, the pneumatic cylinder 34 is actuated to cause rod 105 to move outwardly and bring the pivoted arm 28 to the position shown in dotted outline. The vacuum cups 26 grasp the lowermost cover 20 and, with release, place this dispensed and separated cover on the guideway 40. It is to be noted that the fixed plate 66 and support plate 33 are provided with beveled circular apertures 106 and 107 to insure free passage therethrough of a cover 20. These apertures are made of the maximum size to pass the largest cover 20. It is also to be noted that a center post member 108 is carried by the arm 28 and is conventionally a socket-head cap screw 109 which has its threaded end mounted in and secured in a threaded aperture in circular plate 27.

Seen in FIGS. 1 and 4, the upper attachment of the guideway 40 to the retaining support plate 33 is as by threaded studs 110 and nuts 111. The support plate 33 is threaded to accept such studs. Hangers 112, as indicated in FIG. 1, are provided on and pivotally provide support 113 for the guideway 40. Also seen in FIG. 4 is a cap screw 115, spacer 116 and nuts 117 that are disposed to removably secure housing 23. This cap screw 115, spacer 116 and nuts 117 are disposed to retain the cam-follower bearings 82 in between support plate 33 and upper fixed plate 66 by means of the head of the cap screw 115 and the nut 117 above plate 66. The spacer 116 is positioned above plate 66 and supports the top extent of housing 23 which is secured in position by a like second nut, also identified as 117. In FIG. 5A, the retaining of bearing 82 by pin 90 is depicted.

Figure 5B:
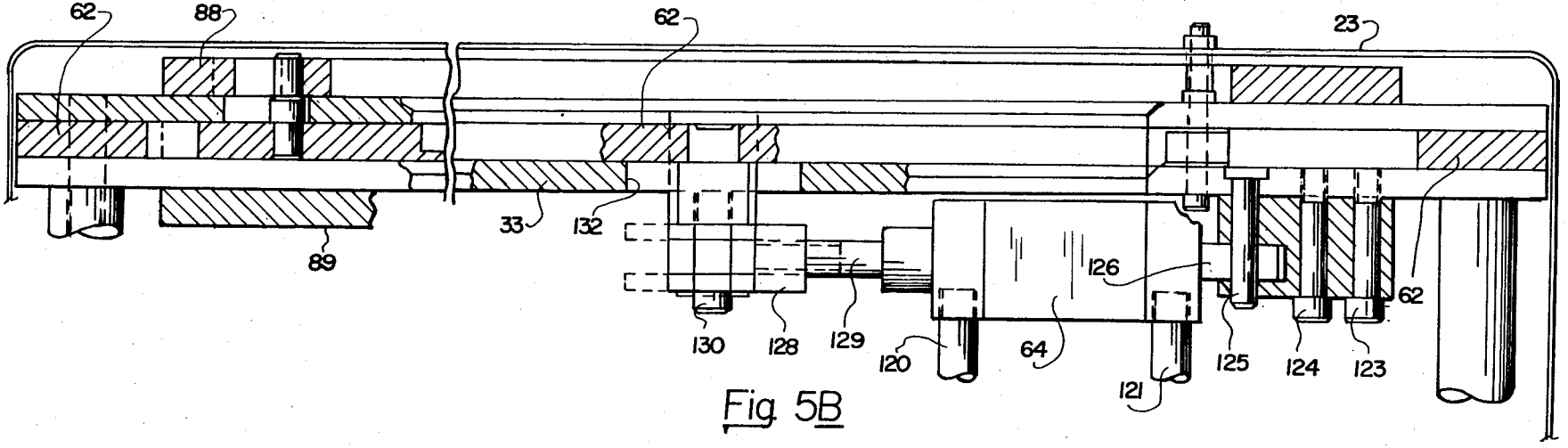
FIG. 5B represents a side view, partly in section and in a slightly enlarged scale, to show the mounting of a pneumatic cylinder by which an outer movable ring member is circled back and forth.

Referring to FIG. 5B, it is to be noted that pneumatic cylinder 64 is shown with inlet and outlet conductors 120 and 121. To fixed support plate 33 there is a retaining block 123 secured to said plate by cap screws 124. A pivot pin 125 enters and retains a pivot end 126 of the cylinder 64. A rod end 127 of this cylinder carries a clevis 128 secured to the rod end. A pivot pin 130 is secured to the reciprocated outer ring plate 62 to move this ring in a back-and-forth arc. A slot 132 formed in support plate 33 allows this back-and-forth movement of the ring 62 by the cylinder 64. Not shown in FIG. 5B are anti-friction cam followers 134 disposed about ninety degrees apart and providing guiding means for the motion of ring member 62. These bearings are seen in FIGS. 3A and 3B and may be like bearing spacers 82 identified above.

Figure 6:
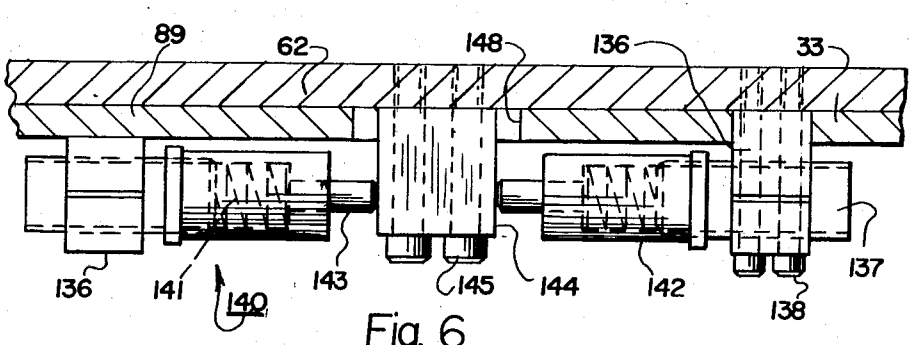
FIG. 6 represents a side view, partly fragmentary, diagrammatic and in section, and illustrates the arrangement of components providing a damping of the cycling motion of the actuating ring.

In FIG. 6 is shown means for damping the back-and-forth movement of ring 62. As seen in this view, like split clamp retainers 136 have threaded transverse apertures that are tightened around a threaded shank portion 137 of a spring shock absorber. A pair of cap screws 138 enter and are retained in threaded holes in plate 33. A fore portion 140 of the damping device has a spring 141, shown in phantom outline in a housing 142, and a plunger 143 which actuates the spring. The more the plunger moves inward, the greater the spring pressure exerted. A stop block 144 is provided and has two through holes carrying cap screws 145 whose threaded ends enter and are secured in tapped holes in outer movable plate 62. A clearance slot 148 in plate 33 allows block 144 to be moved with the rotation of ring 62. FIG. 7 has been discussed above.

Figures 8A, 8B, 8C, 11A, 12A:
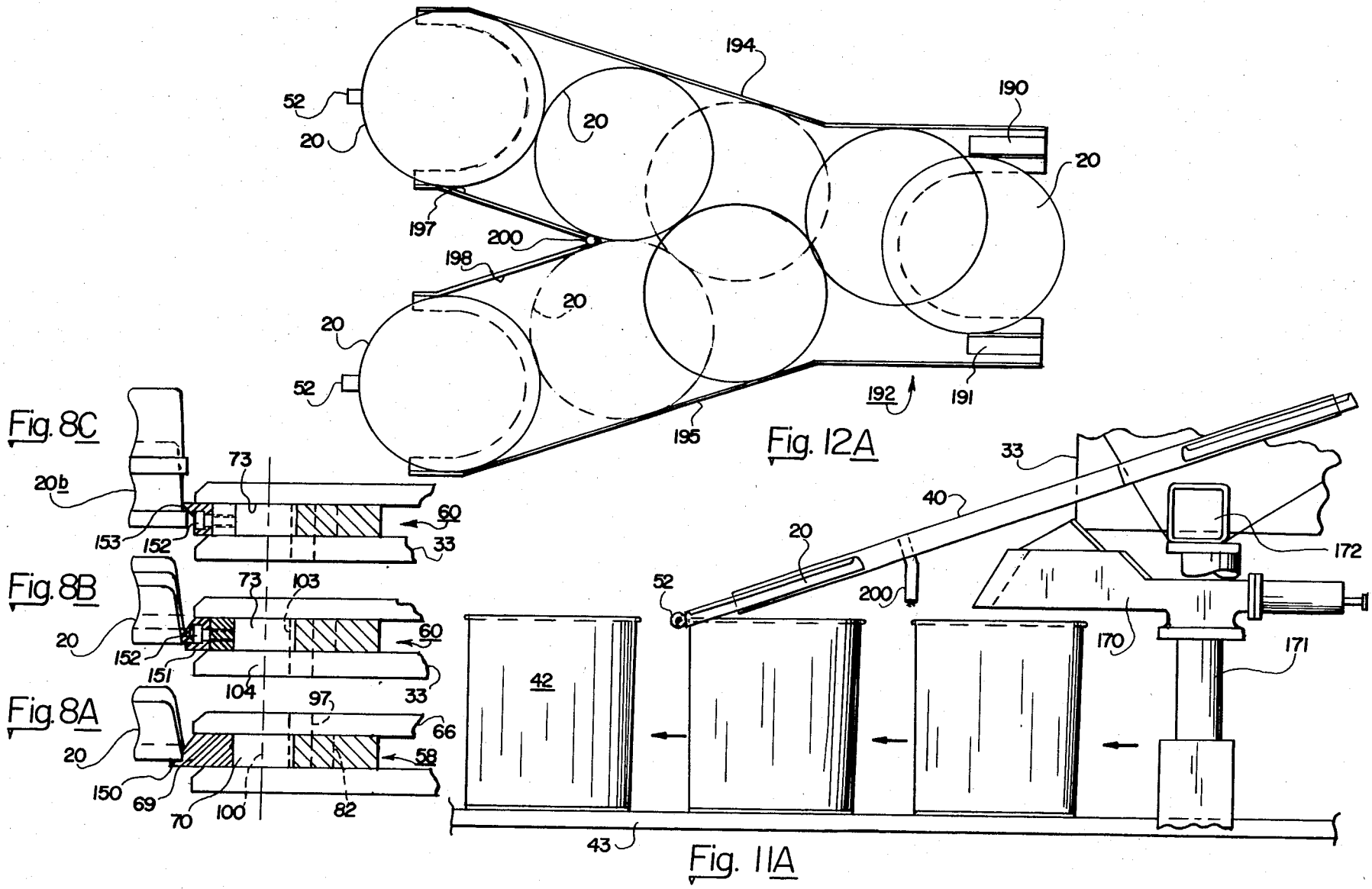

In FIGS. 8A, B and C, the inwardly-working ends of jaws 58 and 60 are depicted. In FIG. 8A, jaw 58 is shown and it is used for dispensing all covers 20 whether metal or plastic. The protruding and supporting lip portion 150 provides a lower supporting shelf for the cover 20. As seen in FIG. 3A, this jaw is formed with a pocket 70. The dotted lines indicate the pin 97 and roller 82 is indicated. In FIG. 8B, the jaw 60 is depicted with the face portion 151 secured to the body of said jaw by cap screws 152. This showing is for a jaw face portion 151 adapted for a metal cover. It is to be noted that pin 103 extends downwardly through support plate 33. It is to be noted that the contoured portion 151 also is disposed to engage and support the lower edge of a metal cover. In FIG. 8C, the cover is plastic and, for the purpose of identification, is **20*b*, and it is to be noted that jaw end 153 is contoured and secured by cap screws 152** so that the protruding lip portion is above the rim portion and engages the side of the cover at a position above the formed rim portion.

CLAMP EMBODIMENTS OF FIGS. 9A AND 9B

It is desirable that the top and bottom adjusting rings 88 and 89, as moved by levers 55 and 56, be clamped after adjustment. Adjustment of the upper and lower rings is made with the rings in an unclamped condition whereat and as a knob 155 is turned to tighten or loosen an associated clamp bar. In FIG. 9A, the knob 155 has a threaded center aperture and is mounted on a stud 156 and urges clamp bar 157 downwardly toward top-adjusting ring 88. An aperture is formed in both clamp bar 157 and base plate 33 and a spacer portion 158 is disposed therebetween. Reduced end portions 159 enter and are seated in the apertures formed in the clamp bar and base plate. A threaded hole 160 is formed in base plate 33 and stud 156 is screwed thereinto and, if desired, a nut **156*a* may be used to secure this stud in a fixed position. A cutout or shoulder retainer end 161 is provided in the end of clamp bar 157 and engages the top adjusting ring 88. A washer 162 is provided under knob 155** to enable turning of the knob.

In FIG. 9B, clamp bar 157 is used but reversed so as to clamp the bottom adjusting ring 89. Rather than stud 156, as in FIG. 9A, a cap screw 163 is utilized. Under said head of cap screw is placed washer 162. The clamp bar 157 is retained in orientation by positioning with spacer 164 between reduced end portions **164*a* and 164*b*. A small securing dowel or pin 163*a* enables knob 155 to rotate stud 163** to cause the clamp bar to be drawn and released from clamping condition.

USE AND OPERATION OF CLAMPS OF FIGS. 9A AND 9B

The upper and lower adjusting rings 88 and 89, as viewed in FIGS. 3A and 3B, are adjusted by the levers 55 and 56 when the clamp bars 157 are in a disengaged or relaxed condition. Knobs 155 are each rotated to loosen the clamp bars 157 associated therewith and allow the rings to be adjusted to the desired position by the associated lever whereat the rings are clamped to retain this adjusted position. To clamp the upper ring 88, which controls the guides 24 and jaws 58, knob 155 is rotated to bring the cutout shoulder portion 161 of the clamp bar 157 downward. This downward pressure causes the ring 88 to be retained against the upper plate 66. The stud 156 is fixed and clamp 157 slides thereon. Washer 162 allows knob 155 to be rotated to provide the desired clamp pressure. There is a small aperture formed in cover 23 for the free movement of washer 162 to and away from the top of clamp bar 157. As the spacer 158 establishes the height at the outer end of the clamp bar, the rotation of the knob 155 causes a tightening or loosening of the jaw clamp.

The clamp of FIG. 9B uses a like clamp bar 157 but, rather than mounted on a fixed stud as in FIG. 9A, the cap screw 163 is rotatable and is moved up and down in the threads 160 in plate 33. Washer 162 permits the rotation of the head of cap screw 163 against the outer surface of the clamp bar 157. The securing dowel or pin 163*a* insures that the cap screw 163 is positively rotated by knob 155. Spacer 164 is very thin so as to accommodate the spacing desired under plate 33.

EMBODIMENT OF FIGS. 10A AND 10B

In FIGS. 10A and 10B there is depicted the proposed construction of the four cover guides 24. Each guide is an assembly and consists of an upright metal member 165 which may be about eighteen inches high when covers 20 are manually loaded or may be about eight inches in height when automatic loading of the apparatus is contemplated. Welding is used to secure a guide member 93 (FIGS. 3A and 3B) to the upright 165. The member 93 is formed with bevel ends 166 to provide unsharp corners. An aperture 167 is formed and precisely positioned so as to fit-retain the pin 92 discussed in conjunction with FIGS. 3A and 3B. The guide member 93 is precisely finished along its sides and thickness so as to slide between plates 33 and 66 and be guided and retained by pins 94. It is to be noted that the upper extent of member 165 is formed with a bevel 168 terminating with a radius to eliminate a sharp corner. This bevel or chamfer 168 provides a guide means. It is noted that this apparatus is adjusted to accommodate covers from twelve and three-sixteenths inches to twelve and three-eighths inches and overall thickness of fifteen-sixteenths inches to one and one-half inches.

DISCHARGE CHUTE OF FIGS. 11A, 11B, 11C AND 11D

The discharge chute of this apparatus is arranged to suit the customer's production line and equipment. The cover-placing apparatus is contemplated to separate at least thirty covers per minute although the filling of pails or containers 42 may be at a much slower rate. If this occurs, plural filling and conveying lines may be employed. Later FIGS. show alternate chute arrangements. In FIG. 11A, a diagrammatic representation shows the apparatus with discharge chute 40 disposed at a selected downward incline providing the desired gravity flow. As shown, a cover 20 has been advanced to meet a filled pail 42. This pail or container is advanced on a conveyor 43 as and after being filled by the customer's filling apparatus, known to the industry, is further advanced. A filling head 170 is diagrammatically depicted and is carried by a support 171 shown. Seen in this view is a support 172. This support is in the nature of a transverse square tube for the apparatus.

Figure 11C:
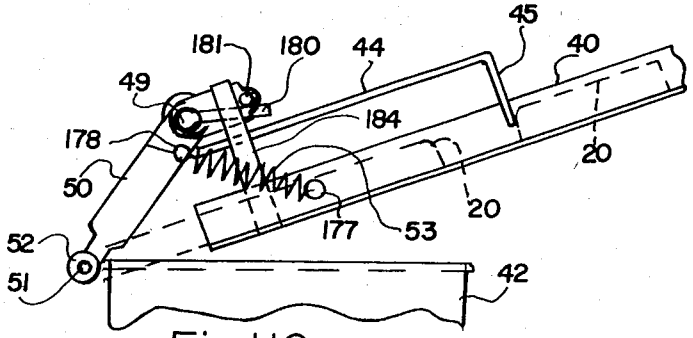
Figure 11B:
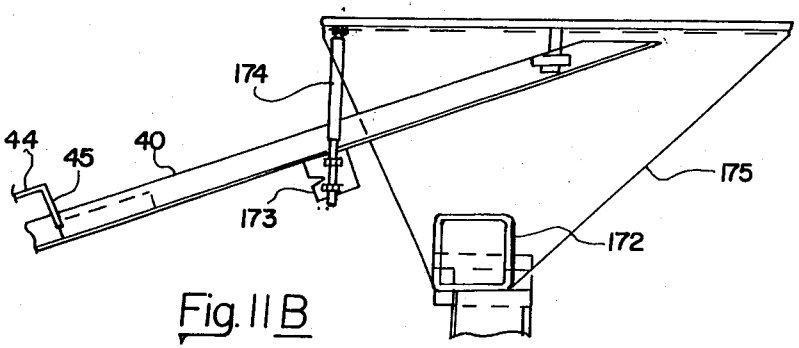

As shown in FIG. 11B, the guideway 40 is carried at its intermediate extent by a transverse support member 173 and hanger rods 174 secured at their upper ends by threads entering compatible threaded portions of the apparatus. Also shown is a sheet-metal guard 175 disposed below the apparatus. In 11C the tension spring 53 is secured at one end to a pin 177 affixed to the outside of the guideway 40 and at its other end to a bent retaining member 178 secured to and in a collar member 179 (FIG. 11D). Seen in these views is a lever arm 180 also secured to and in the collar member 179. This arm is disposed to engage and be limited by a stop pin 181. This pin 181 is provided by a cap screw whose length is sufficient to extend inwardly to provide the desired stop. The threaded portion is used as a tightening and loosening means and is carried by a post clamp member 182. This post clamp member 182 is also seen in FIG. 11C as discussed below. Collar member 179 is tightened or loosened by a cap screw 183. A post 184 is shown as secured to the guideway 40 and carries the spacing and metering means.

As seen in FIG. 11C, clamp screw 181, when loosened, enables the clamp member 182 to be moved up and down the post 184 to accommodate the various thicknesses or heights of the cover 20. As noted above, this thickness conventionally ranges from fifteen-sixteenths of an inch to one and one-half inches. The roller 52 is spring-actuated and presses a metered cover 20 onto the advancing pail or container 42. It is to be noted that this roller 52 is disposed to engage said cover at its leading edge and then traverse this cover (front to back) as the container is advanced, all the while exerting pressure to position the cover on the container. Roller 52, freely rotatable on shaft 51, may be of plastic to provide a non-mar capability as well as slight resilience. As viewed, arm 50 has a collar member 186 which also carries a sensing finger 187 which insures that the cover 20 as it is applied to the top of the container 42 does not lift. This finger 187 may be slightly resilient or flexible. The adjustable positioning of arm 50 along shaft 49 allows the transverse centerline of the roller 52 to be almost on the centerline of the advancing container 42. This adjustability is desired because of the differential of cover diameters. Cap screws are utilized in both collar 179 and 186 to tighten and loosen the collars on shaft 49. Collar member 179 provides a stop locator for the rotatable sleeve 48 on the fixed shaft 49. This collar member is adjacent the post clamp member 182 and the collar member 186 at the other end of this rotatable sleeve 48 selectively positions this sleeve along shaft 49. The collar members are loosened and tightened to adjust the precise positioning of the roller 52 in way of the cover 20.

In FIG. 11D the metering apparatus exemplified shows post 184 secured to the outer wall of the guideway as by welding. Whether the guideway is made from angle iron or from sheet metal, this post 184 is fixed in place. The clamp member 182 is tightened or loosened to be raised or lowered on the post 184. This is achieved by tightening or loosening the cap screw stop 181 which has the threaded portion retained in a threaded portion of the clamp portion of the clamp member 182. This is particularly shown in FIG. 11C. Finger 45 as fixed in a retainer 46 is releaseably and adjustably secured and positioned along sleeve 48 by means of a cap screw (not shown).

USE AND OPERATION OF THE METERING APPARATUS FIGS. 11A, 11B, 11C AND 11D

The covers 20 are dispensed and, one at a time, are advanced by gravity on chute 40. The finger 44 and downwardly-turned end 45 come in the way of a following cover. Roller 52 engages the forward end of the to-be-applied cover to a container 42. As the roller is lifted, the finger end 45 comes in way of the following cover 20 to prevent unwanted advancement. Spring 53 urges arm 50 and roller 52 at the end thereof downwardly to exert the determined placing and positioning force. The lifting of roller 52 and the rotation of sleeve 48 causes arm 180 to move away from the inwardly-extending stop end of cap screw 181. The bent pin 178 is moved clockwise to further increase the tension in spring 53. As and after a container 42 and the positioned-and-placed cover 20 has been advanced by the conveyor 43, the roller 52 and arm 50 move counterclockwise to cause the finger 44 and the end 45 to be lifted from in way of a succeeding cover 20 and permit this succeeding cover to slide to the roller. Since covers may be and are advanced often at a greater frequency than the advancing containers or pails 42, the finger end 45 is adapted to enter a space between contiguous covers on the guideway 40. This showing is shown particularly in FIG. 11C. The up-and-down movement of clamp member 182 on post 184 accommodates the variations in cover thickness and the adjustability of collar members 179 and 188 positions the roller 52 in the desired pathway position. The movement of sleeve 48 along shaft 49 is less than an inch so that the extending bent end of pin 178 retains the end of spring 53 during adjustment.

EMBODIMENT OF FIGS. 12A AND 12B

This embodiment shows an arrangement for the delivery of covers 20, one at a time, to plural delivery guideways. Rather than a guideway 40 for a conveyor line where pails or containers are advanced in single-file array, this showing is for two conveyor lines served by a single separating dispenser. The upper guideway utilizes two angle portions as seen in FIG. 11B. These portions are identified as 190 and 191 and are spaced to accept one cover diameter. The delivery chute is formed with a Y-shape and at the stem portion (at the right) is made wider than the diameter of said covers. It is to be noted that the diverging portions of the Y-chute (into two discharges) become narrowed to, again, just accommodate the diameter of a cover. This enlarged stem portion is generally identified as 192. The outer walls or guides of the diverging portions are identified as 194 and 195. An inner V-shaped guide member identified as 197 and 198 has an apex portion which is supported by and with a rod-like member 200. This support is shown in FIG. 11A as well as FIG. 12A. Rollers 52 are disposed at each of the delivery ends. The design of this chute allows one diverging discharge leg to be filled with covers, after which the other leg will be filled. In actual practice, the delivery apparatus operates at a rate in excess of the consumption rate of the two production lines filling the containers 42. The metering apparatus is shown in FIGS. 11B, C and D discussed above, and when the chute becomes filled there is sensing means providing a shut-down of the separating apparatus to prevent unwanted excess delivery.

AUTOMATIC FILLING OF FIG. 13

In FIG. 13 there is diagrammatically shown apparatus to supply covers to the separating and dispensing apparatus of FIGS. 1 through 12BB as described above. In the embodiment of FIG. 13, covers 20 are placed on a walking-beam apparatus, as shown in my U.S. Pat. No. 4,072,090 as issued Feb. 7, 1978. This patent to the extent applicable is incorporated by reference into this application. Although the above-identified patent was for folded cartons, the walking-beam concept of FIG. 2A through FIG. 6 is also utilized in the FIG. 13 apparatus. A support frame 202 provides precise placing of the covers 20 on a reciprocated beam 204 which is generally and diagrammatically indicated. Side guides 208 retain the covers when arrayed in a vertical manner as indicated. As depicted, the covers 20 are advanced from left to right until a curved guide is positioned to direct the covers to the housing 23 and the vertical guide means associated therewith. The inner guide of the discharged containers 20 is provided by a curved member 206 that replaces one of the guide members 24. As depicted, there are near and a like far guide retainer guides 208 which are made so as to extend horizontally along the sides of the covers 20 and are curved as they provide retainers for the covers as they are discharged to a vertical condition at and around guide member 206. The guide retainers 208 are likewise formed with a curve to provide a restrainer for the advanced covers 20. The stack of covers 20 may be discharged in and with fan-like array without assistance. It is also contemplated when the cover is steel that magnet means may be provided to insure the conformation shown. This same arrangement is also contemplated with plastic covers but, rather than magnets, which are ineffective for non-magnetic plastic, the use of belt guides may be added. As seen, the covers are dispensed, one at a time, from the apparatus described above. The guideway 40; finger 44; tip end 45, and roller 52 are as described above.

EMBODIMENT OF FIGS. 14A, B, C, D, E, F AND G

This embodiment is primarily used for covers 20 of metal having small apertures 210 formed in each scallop 211 portion to allow the secured cover to be removed by a screwdriver, blade or the like (see FIG. 13). Plastic covers do not have this problem, although other problems are present and will be addressed in later FIGS. When metal covers are to be separated and dispensed one at a time from this apparatus, there is sometimes a problem or tendency for the metal covers to have a scallop or scallops 211 partially enter or engage an aperture 210 of an adjacent cover 20 (FIG. 13). The jaw member, generally identified as 60, is replaced by an alternate jaw which is substituted. This jaw has a removable face portion secured to a shank portion 212 having four counterbored holes 214 therethrough. Formed pocket 70 and cutout 71 are as described above. In the new shank 212, the four counterbored holes 214 are positioned on a common centerline and precisely spaced from each other. An arcuate contour 215 is provided at the outer edge and a shoulder cutout 216 is formed so that the counterbored holes 214 are disposed in the extending lip portion. A bevel 217 is formed at the upper inward edge of said jaw 212.

In the shank portion 212 there is also formed a countersunk hole or aperture 218 for the mounting therein and retention of pin 103, identified above in conjunction with jaw 60. In FIGS. 14C and D, there is depicted an insert block 220 having a curved face portion 221. This block is sized and designed to fit in the cutout 216 formed in the shank 212. There are four drilled and tapped holes 222 spaced and sized to accept the threaded shank portion of cap screws 223 (FIG. 14G) provided with each jaw member and shank 212. A spring steel insert 225 is shown in FIGS. 14E and F. This insert of spring steel is about twenty-thousandths of an inch in thickness. A multiplicity of clearance holes 228 are formed, precisely positioned and spaced in this spring jaw insert. An arcuate face 229 is formed in a longitudinal face extent and a saw cut 230 is made from each hole 228 to the arcuate face or edge.

OPERATION AND ASSEMBLY OF JAW

In FIG. 14G, the assembly of the jaw of FIGS. 14A through F is shown. In the shoulder cutout 216, the sheet steel insert 225 is positioned so that the through holes 228 and counterbored holes 214 are aligned. The insert 220 is now positioned so that the curved face portion 221 is positioned as in FIG. 14G, with the threaded holes 222 aligned with adjacent holes and cap screws 223 are tightened into the threaded holes 222. In use, the jaw is positioned in the dispensing apparatus so as to replace jaws 60 with end 78 of Y-member 75 seated in the pocket 70.

In operation, it is to be noted that the spring steel finger insert 225 extends about a thirty-second of an inch beyond the contoured edge 215. These finger portions are disposed to enter an aperture of apertures 210 to cause the scallops 211 partially positioned therein to be engaged and such retained scallop portions to be slightly displaced inwardly to provide disengagement during separation and operation of the vacuum cups on the lower-most cover.

EMBODIMENT OF FIGS. 15A THROUGH 15E

In certain embodiments it has been found desirable to provide ready adjustment of the height of the separating and dispensing apparatus as described above. The up-and-down motion is to accommodate changes in the height of containers 42. As depicted, square tubing support member 172 is secured to a plate member 235 and this plate member is welded to a tubular member 236 disposed to extend downwardly and at a substantially vertical position. This tubular member is retained by clamp portions 238*a* and *b*, seen in plan array in FIG. 15C. There are shown two camp assemblies, but there may be more if desired. The inner half 239 is secured by studs and nuts 240 and 241 and these studs pass through holes formed in angle iron portions 242 which provide a frame portion. Cap screws 243 are shown as holding the outer cap portion of the clamp in retaining position.

Adjustment up and down is provided by a handwheel 244 secured to and adapted to rotate shaft 245 extending transversely through the tubular member 236. A collar member 246 is mounted on the other end of shaft 245 to position this shaft in the tubular member 236. A flexible wire or cable 247 has a plurality of wraps on the shaft with an upper end of the wire secured in a hole formed in a spine member 248. This spine member is a rectangular steel bar carried within the tubular member. The lower end of said tubular member has a large portion removed at 249 to provide access to the interior of the tubular member 236. An L-shaped bracket 250 has a guide hole formed therethrough and a rod-like member 251 is slideable in said hole. A transverse hole 252 is formed in and through the upper end of this member 251 and the lower end or wire or cable 247 is secured therein. An enlarged retainer member 253 is provided at the lower end of this rod-like member and a compression spring 254 is mounted to the rod-like member 252 and the L-shaped bracket 250.

In FIG. 15C there is shown a tubular supporting shell 256, which is preferably a half-section of a tubular pipe member sized so as to be a sliding fit with the outer surface of tubular member 236. This half-section support member extends between clamp portions 238*a*, 239*b* and a lower-half clamp portion 258, seen in FIG. 15D, which is like or very similar to the inner half 239, seen in FIG. 15C. This tubular shell 256 is attached to these half-clamp portions as by welding. Below the clamp assembly 238*b* is the upper end of the cutout 249 and at the lower end of this cutout is the clamp half 258 as seen in FIG. 15D. It is to be noted that cap screws 260 and nuts 261 retain the clamp half 258 to the angle-iron frame portions 242.

In FIG. 15E there is depicted a screw clamp adapted to retain the adjusted support in the desired position. As seen at inside of the tubular member 236 are two stanchion members 263 and 264 that at their outer ends are secured to a cross-head member 265. The tubular member 236 is made with two slots which allow the ends of the stanchions to move in and out slightly in the tubular member. A cap screw 267 is carried in a nut 268 welded to the tubular member 236 and passes through a hole formed in said tubular member. This screw 267 is shouldered and has a reduced inner end portion 269. This reduced portion is sized to enter and be retained in a transverse hole 270 in the cross-head member 265. A friction or brake block, identified as 272, that engages and retains wire 247 has a pin 273 extending rightwardly from the block 272 and this is mounted in hole 270 so as to provide retaining means of the block 272 with cross-head member 265. More retaining pins may be provided as well as screws or movement-limiting shoulders formed on either the block 272 or the cross-head member 265. As shown, the block 272 and cross-head member 265 are about the same length.

It is to be noted that with cap screw 267 removed, the welded U-shaped assembly of stanchion members 263 and 264 and attached cross-head member 265 may be removed from the tubular member 236 by moving the left ends of said stanchions from formed slots in tubular member 236. The weldment is lowered and friction block is then removed from this U-shaped weldment and examined for wear or damage. If either has occurred, this friction block may be repaired or replaced.

It is also contemplated that a counter balance be provided for the separating-and-dipsensing apparatus shown and described above. Counter-balance apparatus is not shown as installation conditions are a criteria. Brake means, such as is conventionally used in building elevators, is also contemplated. It is desired that when clamp screw 267 is loosened, the dispensing apparatus means remain in the positioned placement provided by the lifting and adjustive handwheel 244. The wire or cable 247 may be secured to the shaft 245 rather than at the upper end of the spine member 248. It is also contemplated that instead of the wire or cable exemplified, the raise-and-lower apparatus may employ a rack and pinion or a pneumatic lift cylinder may be employed. The clamp shown is used with a screw, but other clamp means may be utilized. The clamp apparatus depicted in FIG. 15E is only illustrative and is not a distinction.

OPERATION OF THE LIFT AND CLAMP APPARATUS OF FIGS. 15A THROUGH 15E

The raising and lowering of the separating-and-dispensing apparatus, as in FIGS. 1 and 2 and subsequent FIGS. above, contemplate that clamp screw 267 is loosened to allow tubular member 236 to be raised and/or lowered by turning handwheel 244. The wire or cable 247 is tightly wound around shaft 245 which is rotated to provide the desired height of the dispenser above the containers 42 as they are moved along the conveyor 43. After adjusting to the desired height, the clamp screw 267 is again turned inward to cause friction block 272 to be pressed against the spine 248. It is to be noted that the wire or cable 247 is also immobilized as to its movement. Spring 254 keeps the wire or cable taut so that wraps around the shaft 245 are tight enough to insure movement up or down of the apparatus as the shaft is rotated.

Figure 16E:
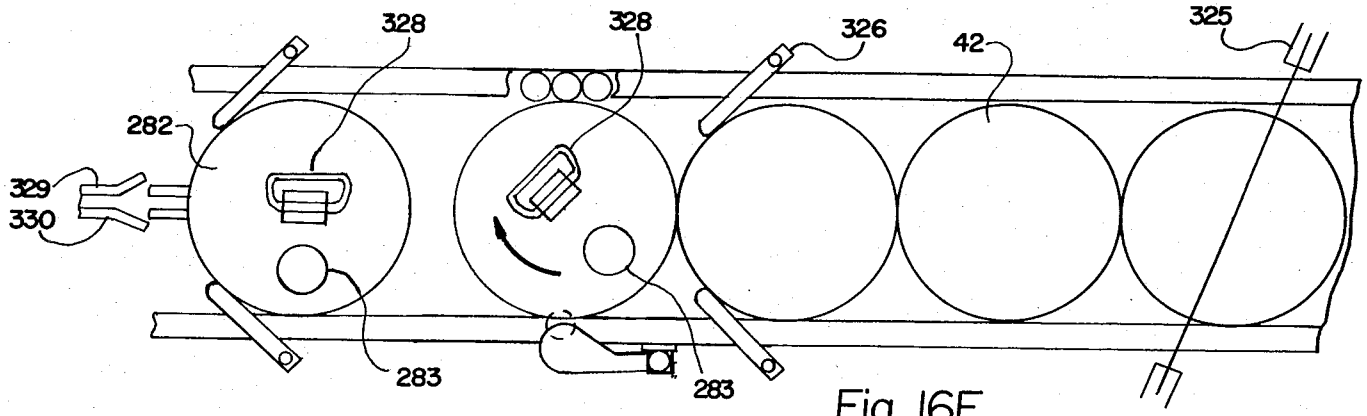
Figure 16B:
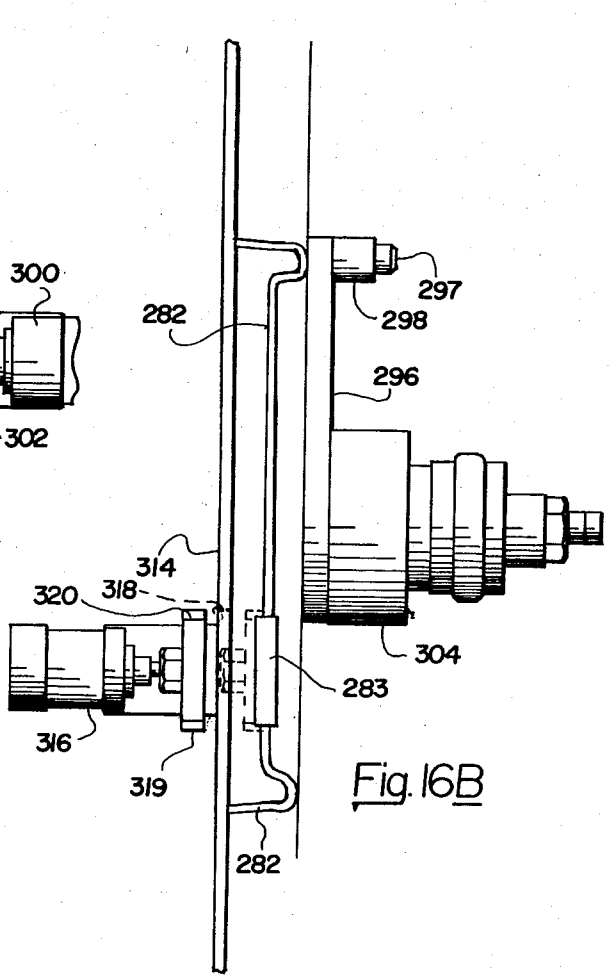
Figure 16A:
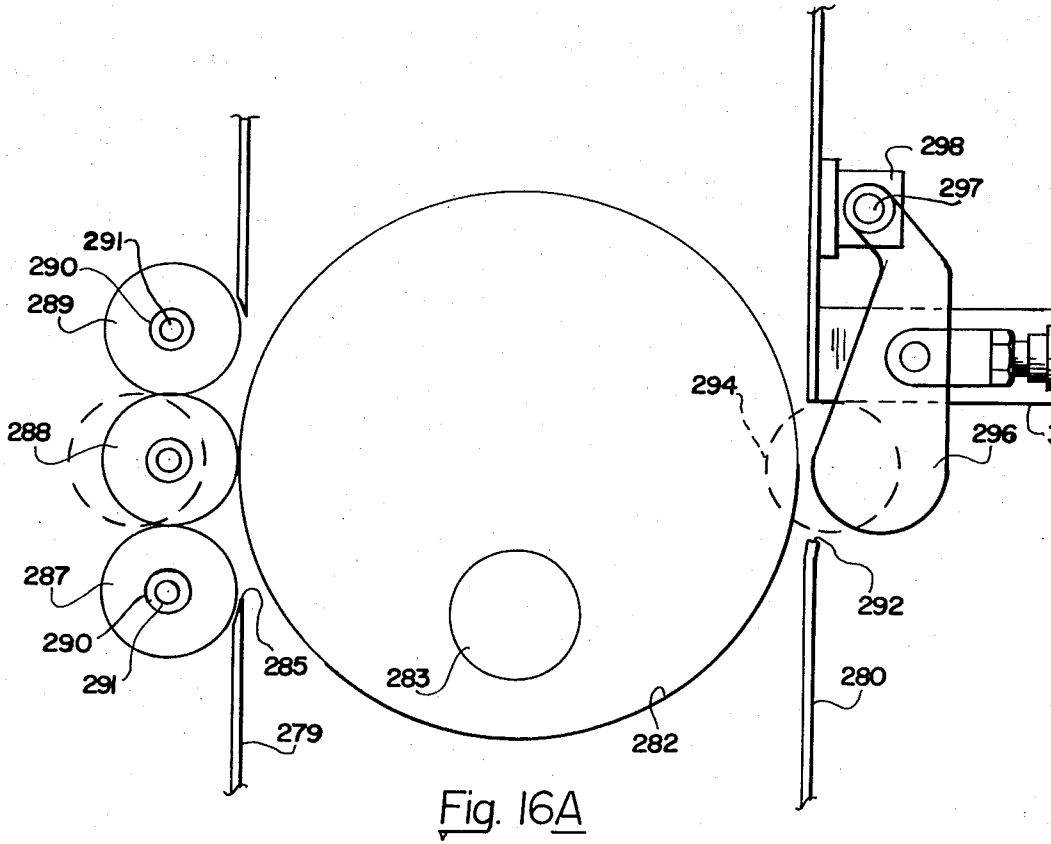

ORIENTING DEVICE FOR COVERS HAVING BUNGS OR SPOUTS IN THE COVERS—FIGS. 16A, B, C, D AND E

Certain pails or containers 42 are filled with fluid or semi-fluid products which at the time of use are poured from the pail or container through a spout in the cover. Often, such covers are affixed to the pail or container so that the covers are difficult to remove and the pry-off scallops may be of a different design. These covers, although separated and dispensed with and by the apparatus as described above, are also oriented to insure placement on the containers and positioning of the containers for labeling in a desired position. It is contemplated that this orienting device is used with modification or modifications to the delivery chute 40. The alteration is made to accommodate assembly problem or problems. These pails or containers may have ears and attached bails, as shown in FIG. 1 of my U.S. Pat. No. 4,344,522, as issued Aug. 17, 1982, or may have a pivoted handle (FIG. 16E) in the cover, usually at the center or near the center thereof.

In either condition, the manufacturer of the pail contents usually desires to place a label on the side of the container or pail at a particular position with relation to the nozzle or spout. This is particularly desired with containers havings bails inserted into ears, as depicted in my U.S. Pat No. 4,344,522 noted above. Label-applying apparatus is commercially known and is often particular to the customer's production line. Orienting and "spot" reading for the placing of a label on the container are quite important. This orienting and "spot"-detection apparatus is shown and claimed and in the above-identified U.S. Pat. No. 4,344,522 and the divisional U.S. Pat. No. 4,383,601, as issued May 17, 1983, both of which to the extent applicable are incorporated by reference into this application. It is very desirable that the covers be separated, dispensed and then oriented so that the spout or bung hole is placed in the desired position on such containers. Palletizing or case-packaging after filling the containers or pails often requires particular orientation to accommodate the precise positioning of the bails to protect the labels or to prevent damage to the case or bails.

In FIG. 16A is depicted a diagrammatic plan view of the discharge track 40 altered to provide orientation apparatus. The track or guide, for the purpose of identification, has a left-side retainer 279 and 280 for a right-side retainer. A cover 282 has a nozzle or bung outlet 283 formed and provided in the cover, which is usually of sheet metal, but is not limited thereto. There is provided a rotating means for the cover when and while in a given position. Metering means is provided before a single cover is advanced to an orienting station. As shown, the cover 282 has a nozzle or bung outlet 283 and preferably this outlet is positioned in only one position, but this is not to preclude the positioning of the outlet in one of two attitudes, usually at right angles to the axis of the conveyor line of movement. A cutout 285 is made in the left-side upstanding retainer means 279 and in this cutout there are disposed three rollers, identified as 287, 288 and 289. It is to be noted that the center roll 288 is carried on an arm, not shown, and is urged inwardly by a spring means so that this roll engages the side of the cover 282 and, with and when a turning application is applied, is moved leftwardly to provide a three-point retaining support for the cover 282. It is noted that the rollers 287, 288 and 289 are preferably of plastic and utilize anti-friction bearings such as ball bearings 290 to make the rollers free-turning. Shafts 291 are provided for mounting these rollers and bearings so as to rotate freely in the desired plane.

The right retainer 280 also has a cutout 292 into which a powered drive roller 294 is moved to engage and rotate the cover 282 in and at this station. An arm 296 is pivotally retained and carried by a pin 297 mounted in and on a support block 298. This arm is moved in and out by a pneumatic cylinder 300 (FIG. 16A) carried by a bracket 302. Both the support block 298 and bracket 302 are shown as carried by the right side wall retainer 280.

Drive roller 294 is rotated by a gear motor 304 carried by the pivoted arm 296 and is moved in and out by the pneumatic cylinder 300. This cylinder is disposed to move roller 294 into and away from engagement with the side of the cover 282. The construction of roller 294 is shown in FIG. 16C and, as depicted, is made with a metal flanged hub portion 306. A set screw retaining means is carried in a threaded hole 307 in this hub and a mounting bore 308 is provided for mounting on the drive shaft of gear motor 304. A plastic tire (preferably polyurethane) is identified as 309 and a retaining face disc 310 is used with a plurality of flat-head screws 311 to removably retain this tire in place on this flanged hub.

Referring specifically to FIG. 16B, a diagrammatic side view of this orienting device shows a support plate 314 on which the cover 282 is diagrammatically rested. In this cover is indicated outlet 283 which is orientated and precisely positioned. The support plate 314 has a pneumatic cylinder 316 carried thereby by a support bracket, not shown. An aperture 318 is formed in support plate 314 and a plate member 319 is movable in and out. This aperture engaging and positioning plate member 319 has a formed recess 320 therein sized to receive and engage the inwardly-extending circular portion of the outlet 283. It is to be noted that the plate member 319 is larger than the outlet 283 so that the plate member provides a platform which engages the end of outlet 283 and slides by the outlet until said outlet is engaged in recess 320 at the desired orientation. Support plate 314 is used in and with the bottom of the chute to provide the desired orientation. This plate is removable and the positioning is a matter of the customer's requirement. This cylinder 316 lifts the plate member 319 until the recess 320 engages and positions nozzle portion 283. After positioning has been achieved or established, pneumatic cylinder 300 is retracted so that spring-actuated roller 288 urges the cover 282 back into the desired position after which the cylinder 316 lowers plate member 319 below support plate 314.

IN FIG. 16E there is diagrammatically shown a delivery system in which a series of containers 42 are delivered on conveyor means. When and where the covers have a small handle, the covers and spout arrangement are usually similar to the diagrammatic arrangement of FIG. 16E. It is noted that a back-up sensor 325 is indicated to prevent undue accumulation on said conveyor. This back-up sensor is conventionally an electric-eye device, although not limited thereto. An escapement apparatus 326 is also provided so as to release only one container at a time for covers 282 delivered by gravity. The cover is then rotated to insure placement of the cover with the outlet 283 in the desired orientation. As depicted, the cover is secured to the container and a lifting (usually magnetic) device is used to bring each pivoted handle 328 to an upright condition and guide rails 329 and 330 are utilized to insure transfer to labeling, palletizing or other customer operations.

When the containers or pails have bails secured in ears on the sides of the containers, the containers are oriented by ear-engaging devices using the presence of ears. After placing the cover, using the apparatus of FIGS. 16A through D, the bailed container is moved forwardly and, with the cover affixed, the bail is lifted to a substantially vertical condition and positioned between guide rails 329 and 330, with the container advanced to further packaging operations.

ADJUSTABLE ARM APPARATUS OF FIGS. 17A, 17B AND 17C

Figure 17C:
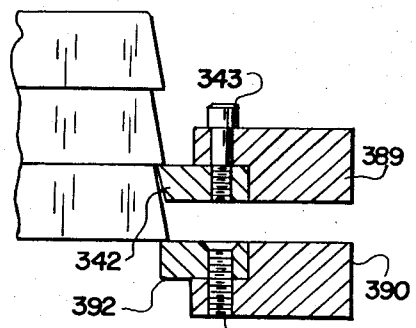
FIGS. 17A, 17B and 17C represent alternate plan and sectional views, partly diagrammatic, of alternate means for clamping and separating covers, this alternate apparatus adjustable for a large range of diameters.

Rather than the limited adjustment provided in FIGS. 1 through 7, the cover separator and dispenser may be made to suit cover requirements of as small as six inches and to the largest used with five-gallon containers, which is about twelve inches. It is readily seen that more or less diameters may be accommodated. As seen in FIG. 17A, there are four clamp arms 340, each having a replaceable facing ledge portion 342. These ledge portions are removably attached to the arms by screws 343. These ledge portions are contoured to suit the cover to be positioned and dispensed. Each clamp arm is provided with an actuating arm end 344 which is made integral with the clamp arm portion 340. A retainer 346 is removably secured to an arm actuating upper ring 347. As depicted, this retainer 346 includes a pivotal socket 348 and a circular member 349 having a slot 350 centrally positioned and sized to be slideable on the extending end of the actuating arm 344. Retainer 346 is precisely positioned by dowel pins 352 and secured to the ring 347 by cap screws 353. There are four arms 340 depicted, but at least three are required and there may be more than four.

A support ring 355 is provided and is carried by the support plate 33 seen and identified above. Two pneumatic cylinders are carried on and by this support ring 355 and each is actuated in response to an electrically-actuated signal. These cylinders are identified as 357 and 358. The cylinder 357 actuates the clamp arms 340 by moving the support ring 347 in a very limited arc, usually less than a half inch. This cylinder is pivotally retained at one end by a clevis and pin 360 and 361 which are pivotally connected to an arm portion 363 which is a portion of ring 347. The other end of cylinder 357 is pivotally secured to an adjusting link 365 which has a slot 367 therein and through this slot and into the support ring is a cap screw 368. Mounted in a threaded portion in support ring 355, this actuating ring 347 is rotatably retained in the desired position by bearings. The initial positioning of ring 347 is by loosening up screw 368 and moving the arm portion 363 back and forth which moves the arm 340 inward or outward. The cap screw is again tightened to secure the ring 347 in the desired attitude. A small movement of the ring 347, as provided by the cylinder 357, is sufficient to move the arm 340 outwardly to provide clamp release of a cover.

Figure 17B:
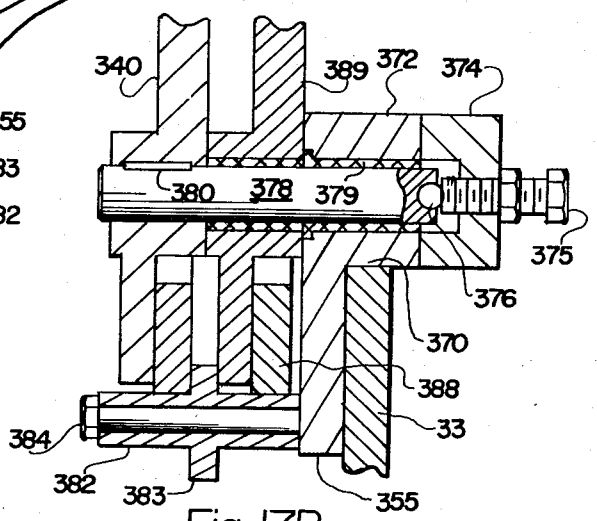
Figure 17A:
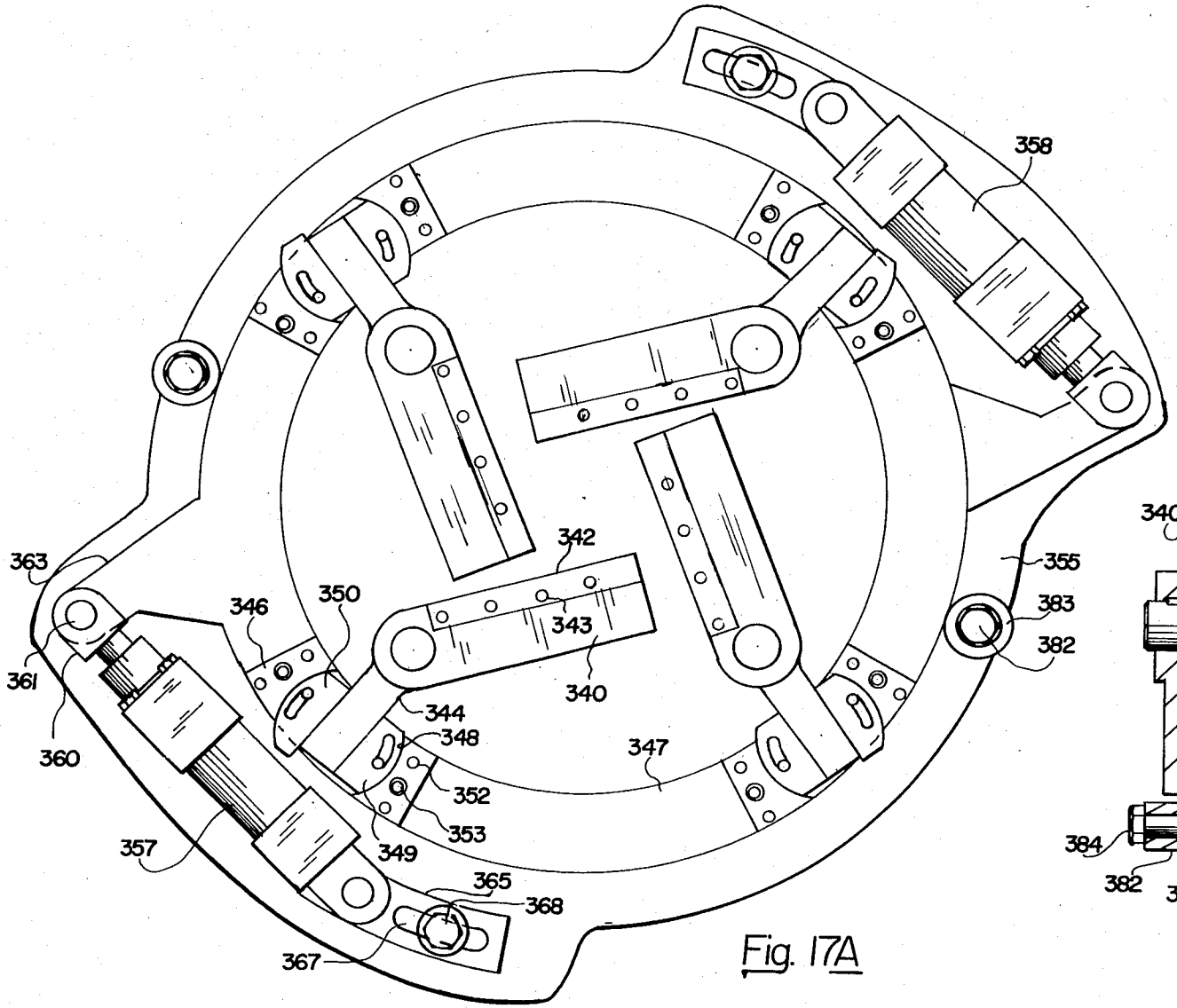

As seen in FIG. 17B, there are two arms stacked one above the other and utilizing the same mode of operation. This FIG. fragmentarily and diagrammatically shows in section the support or bottom plate 33 provided with apertures 370 (one for each set of arms) in which is mounted and secured a boss portion 372. Each boss portion has an end cap 374 carrying a cap screw 375 in a threaded hole and with the inner end of this cap screw engaging a ball 376. The adjustment of this screw raises and lowers shaft 378 in a sleeve bearing 379. A key 380 is shown as insuring rotation of the shaft 378 as arm 340 is moved by ring 347.

In both FIGS. 17B and 17C, the clamp arm 340 is depicted and is moved in a controlled arc by the cylinder 357 as it moves ring 347. This ring 347 is retained in centering position by centering roll 382 which is depicted with an enlarged center ring portion 383. This roll is carried on a cap screw stud 384 mounted in a threaded hole in support ring 355. The smaller exterior diameters of this centering roll 382 are disposed to center ring 347 and an escapement ring 388 moved by pneumatic cylinder 358. This escapement ring has an extending arm 389 similar or substantially identical to arm 363. Adjustment is as that for cylinder 357. A set of escapement arms 390, like arms 340, is carried immediately below arms 340 and, as seen in FIG. 17C, has a replaceable lip portion 392 secured by flat-head cap screws 393.

The apparatus of FIGS. 17A through C, although discussed primarily for use with round covers and containers, may also be used for covers that are not truly circular. This includes covers that are substantially square or are oblong as well as of irregular shapes. The guide means has to be contoured and erected to suit the particularly-shaped cover that is to be separated and the clamp and escapement arms contoured to suit. The clamp and escapement arms are actuated only a small distance no matter the shape of the cover. The metering and positioning apparatus, in conjunction with the chute, is designed to suit the particular mounting requirement of the cover to the container.

It is also to be noted that this embodiment shows arms in stacked array and that these arms are pivotally moved around a pivot post or pin while the jaw members of FIGS. 3A and 3B are arrayed, side by side, in a common plane. In either embodiment, the lower rim of the bottommost cover is provided with a support until actuation to remove the support and the vacuum cups engage said cover and move the cover from the stack. The next-above cover is clamped during this period of time and said second cover is supported during escapement of the first cover.

Metering means, whether to one or to two guideways, is shown with a rod and carried by the pivoted shaft. This is not to preclude other metering means such as a pneumatic control finger and sensing device. The roller 52 is shown as a simple and effective means of pressing the cover to and onto the upper rim of the container, but other means such as a presser belt may be employed. Particular cover configurations and conditions may cause alternate constructions. The depicted apparatus is shown as cost- and operation-effective.

It is to be noted that the embodiment of FIGS. 17A, 17B and 17C does not require the guide bearing and pins for the jaws and guide members as shown in the embodiment of FIGS. 1 through 6. The jaws 58 and 60 of FIGS. 3A and 3B are moved in and out by the reciprocated ring 66 with only one pneumatic cylinder 64, while the embodiment of FIGS. 17A, B and C utilizes two pneumatic cylinders 357 and 358. The arms 340 and 390 replace the jaws 58 and 60 and are swung in an arc rather than moved reciprocably. Both the upper and lower arms 340 and 390 have replaceable face portions which may be contoured for a cover of any furnished configuration. The adjusting screw 375, although shown below the top surface of the apparatus, may be carried above so as to extend downwardly with a thread and left shoulder adapted to raise and lower the upper clamp arm to suit a cover configuration. Whether called jaws or arms, the escapement and clamping of the covers provide like means. The configuration of the clamp arms is made to suit the cover configuration and size.

It is to be noted that the apparatus of FIGS. 17A, 17B and 17C employs a support ring 355 mounted and carried by support plate 33. Rather than move outer ring 62 moved back and forth by a pneumatic cylinder 64 with a damping device as shown in FIG. 6, this alternate apparatus of FIGS. 17A–C utilizes two pneumatic cylinders 357 and 358. These cylinders are actuated in response to a signal (usually electronic) that provides a clamping action with one set of arms while the other set of arms is actuated to provide escapement of the lowermost cover. This alternate-apparatus concept enables the arms to be adjusted to stack, clamp, release and deliver covers having a size differential of more than six inches in diameter. This is merely a size currently in use with covers for one- to five-gallon containers and is not limiting as to size as this concept shows a principal that may be used with a range of containers of other configurations and sizes.

The apparatus, as shown above and described, contemplates covers of both metal and plastic. This apparatus is disposed to receive, stack, separate, dispense (one at a time) said cover and, by gravity, deliver said cover to a metering, positioning and placing station. Said cover is seated on a traveling container in a more-or-less mounted condition. When and where the cover is of plastic, it is usually a molded product and subject to distortion (mainly warping). This warping distortion may be produced when the cover is removed from the mold or may occur in shipment and/or storage. The above apparatus is shown for covers with little or no distortions. The cover, when warped or otherwise distorted, is accommodated with auxiliary apparatus, usually in the form of pneumatic cylinders and sensing signal devices.

Although distortion or warping of plastic covers is limited sufficiently to enable stacking, separating and dispensing, this does preclude difficulties with warped covers in the positioning and seating of said covers on the open top rim of a container or pail. There are two problems with warped or distorted covers: (a) the warp causes the forward or front edge of the cover to be lifted from in way of the advancing container, and (b) there is a potential shingling of covers on the delivery chute. When and where the warp in the cover is such that the cover is disposed to be elevated so that the bent cover is up and away from the top rim of the container, there is provided auxiliary apparatus (usually pneumatic) that is responsive to an electronic signal means to adjust the warped cover to the top rim of the container. This auxiliary apparatus requires a more-or-less special adaptation for the customer's filling line and problems. This adaption insures that the leading or forward edge of the cover is positioned and pressed into seating position on the container by and with the roller 52.

When and where the warp and/or distortion is such that shingling occurs, or there is a potential for shingling of gravity-delivered covers, there is provided auxiliary apparatus associated with the chute at or above the metering station. Responsive electronic signaling and sensing means is provided and apparatus, usually pneumatic, is used to effectively prevent such an occurrence. Metering apparatus is employed to insure that an excess of covers is not dispensed to and on the feeding chute. The covers and containers used by the customer determine the arrangement and scope of the apparatus which is made to suit the customer's requirements. Warp or distortion problems may require changes after a production line has been established as changes in material and/or processes and equipment affect the cover configuration. The containers may be of plastic and the top rim may be less than round and require one or more special auxiliary equipment assists, and the solution to said problems is special and a general design for said auxiliary equipment is not shown.

The apparatus shown and described above provides a method for cover-dispensing in which the covers are received and arranged in stacked array and then separated and delivered, one at a time, to a gravity chute or guideway, and at a metering and cover-applying station the foremost cover is positioned and pressed on a top rim of a traveling container, said dispensing method including the steps of:

(a) receiving a multiplicity of covers in a stacked array and with guide means positioning said covers in way of separating and escapement means;

(b) arranging at least three pairs of jaws in a radial pattern and disposing said pairs so that a first set of jaws is moved and movable toward and away from a lowermost first cover and providing a support means for a lower rim of said first cover of the stack, and when said jaws are moved away from said first cover, providing escapement of this first cover;

(c) arranging a second set of clamp jaws and moving said second set of jaws toward and away from an above second cover and in timed relationship and concert with the movement of the first set of jaws, this movement alternately providing a clamp and engagement support of the above second cover while the first cover is being released and releasing said second cover after the first cover has been removed from in way of the first set of jaws and the first jaws to a cover-support position and condition;

(d) carrying a plurality of vacuum cups on an arm and swinging this arm and means for actuating the flow of vacuum to and from said cups in timed relationship with the swing of said arm so that the cups grasp the lowermost first cover and move this cover to a delivery position, after which the vacuum is cut off;

(e) supplying and arranging a gravity chute or guideway so as to receive the dispensed covers, one at a time, and in a single thickness array and carrying said covers to a metering station;

(f) metering said dispensed covers on said chute or guideway so that means comes in way of advanced covers to inhibit the progress of a succeeding cover from proceeding to an applying station until the foremost cover has been placed on a traveling container, and (g) positioning and pressing said foremost cover at a cover-applying station by progressively pressing said foremost cover from its leading edge to its trailing edge to and the upper rim of a container while actuating the metering means to prevent undue and unwanted advancement of a succeeding cover.

Terms such as "left," "right," "up," "down," "bottom," "top," "front," "back," "in," "out," "clockwise," "counterclockwise" and the like are applicable to the embodiments shown and described in conjunction with the drawings. These terms are merely for the purposes of description and do not necessarily apply to the position in which the cover-dispensing apparatus with metering- and cover-pressing stations may be constructed or used.

While embodiments showing both separating, delivery and pressing operations and special applications thereof have been shown and described, it is to be understood that the invention is not limited thereto and protection is sought to the broadest extent the prior art allows.

What is claimed is:

1. A cover-dispensing apparatus adapted to receive covers and, in a stacked array, separate and deliver a cover, one at a time, to a gravity chute or guideway whereby and at a metering and at an applying station the forwardmost cover is positioned and pressed on a top rim of a traveling container, said dispensing apparatus including:

(a) guide means for receiving a multiplicity of covers in a stacked array and positioning said covers in way of separating and dispensing means;

(b) a plurality of at least three pairs of jaws radially arranged and disposed so that a first set of jaws is moved and movable toward and away from a lowermost first cover to provide support means in way of a lower rim of said first cover of the stack, and when the jaw is moved from said rim provides escapement of said first cover, after which the jaws are again moved to a cover-support position;

(c) a second set of clamp jaws disposed and moved in timed concert with said first set of jaws, the movement of said second set of jaws toward and away from a second cover, and alternately providing a clamp and engagement of this above second cover while the first cover is released and to release said second cover after the first cover has been moved from in way of the first set of jaws;

(d) a plurality of vacuum cups carried on and by a swinging arm and means to actuate said vacuum and the movement of said arm so as to grasp by said vacuum cups the first cover as it is released by the first jaws and move said first cover to a delivery position;

(e) a gravity chute or guideway adapted to receive the released covers, one at a time, and in a single thickness array, carry said covers to a metering station;

(f) metering means adapted to come in way of advancing covers and to inhibit the proceeding of a following cover to a cover-applying station until a forwardmost cover has been placed on a traveling or advancing container, and (g) positioning and pressing means at said cover-applying station with a cover-applying means progressively pressing a cover from a leading to a trailing edge to and onto an upper rim of a container while actuating the metering means to prevent undue advancement of a succeeding cover.

2. A cover-dispensing apparatus, as in claim 1, in which the first and second set of jaws are disposed to move in the same plane between spaced, fixed support and upper-ring plates and these jaws are actuated in and out by a reciprocated outer ring member.

3. A cover-dispensing apparatus, as in claim 2, in which the outer reciprocated ring member is moved by a pneumatic cylinder and this ring member is in the same plane as the jaws.

4. A cover-dispensing apparatus, as in claim 3, in which there is provided damping means for diminishing the back-and-forth stop shock of the reciprocated and actuated movement of the outer ring.

5. A cover-dispensing apparatus, as in claim 2, in which the first and second set of jaws are moved counterflow to each other by a Y-member having three ends with precisely-formed end portions, one end and formed portion disposed to be seated in a formed pocket in the reciprocated outer ring, and one precisely-formed end portion in the side of each of the first and second jaw members.

6. A cover-dispensing apparatus, as in claim 2, in which there are also upper and lower adjusting rings individually movable in a circular path to position the jaw members at a particular cover diameter and with each jaw member having means in cooperation with an adjusting ring to move the jaw member to a predetermined cover diameter.

7. A cover-dispensing apparatus, as in claim 6, in which the movement of the adjusting ring controlling the adjustment of the jaws, providing escapement action for releasing the lowermost cover, also provides movement of the guide means to a predetermined diameter.

8. A cover-dispensing apparatus, as in claim 7, in which the guide means includes a plurality of support members secured to vertical bar portions, these support members slideably retained on and in the same plane as the jaw members.

9. A cover-dispensing apparatus, as in claim 8, in which the jaws and guide supports each have pins secured therein, with each of said pins engaging the sides of slots formed in the adjusting ring and with said pin and slot, when the adjusting ring is moved clockwise or counterclockwise, moving the pin and the limit of movement of the jaw members and guide bars to establish the diameter of the cover.

10. A cover-dispensing apparatus, as in claim 9, in which guide pins and bearings closely define pathways for movement of the jaw members and guide means toward and away from a theoretical central axis of the dispensing apparatus.

11. A cover-dispensing apparatus, as in claim 10, in which there are provided releaseable clamps for both the upper and lower adjusting rings and with manipulation providing release of these rings for adjustment, after which the clamps are tightened for dispensing of covers from the apparatus.

12. A cover-dispensing apparatus, as in claim 11, in which the upper adjusting ring controls the adjusted position for those pins in those jaw members disposed to control release and support of the lowermost cover and also for the pin used with each guide member, this clamp moving the top adjusting ring into frictional immobility against the fixed upper ring plate.

13. A cover-dispensing apparatus, as in claim 12, in which the lower adjusting ring controls the adjusted position of those pins for the jaw members disposed to control the clamp, support and escapement of the immediately-above cover from the lowermost cover, this clamp when tightened moving the bottom adjusting ring into frictional immobility against the fixed lower support plate.

14. A cover-dispensing apparatus, as in claim 13, in which the upper and lower adjusting rings each have extending arm members fixed to a ring and which arm members are grasped and moved to provide rotational movement of the associated ring to provide the desired adjustment.

15. A cover-dispensing apparatus, as in claim 2, in which the jaw members providing the escapement of the above or second cover also have a replaceable arcuate face portion secured to a shank portion, this replaceable face portion having a contour sized and adapted to clamp and support said second cover while the first or lowermost cover is being withdrawn.

16. A cover-dispensing apparatus, as in claim 15, in which the replaceable face portion is countoured so as to clamp and support a metal cover.

17. A cover-dispensing apparatus, as in claim 15, in which the replaceable face portion is contoured so as to clamp and support a molded plastic cover.

18. A cover-dispensing apparatus, as in claim 15, in which the replaceable face portion is particularly for metal covers having scalloped side portions and with apertures formed in each scallop therewith providing potential means for the scallops of adjacent stacked covers to partially enter and provide an interference fit in said apertures, said assembled jaw face portion having a thin, plate-like metal portion in which an unsupported arcuate portion is slit to provide a multiplicity of extending fingers, some of which enter formed apertures in the scallops in the side portions of the first cover and displace a partially-seated scallop, and with the rest of the fingers not entering an aperture deflected downwardly toward the guideway and toward and to a downwardly-curved support also secured to the jaw and moved therewith.

19. A cover-dispensing apparatus, as in claim 1, in which the plurality of vacuum cups is carried by a support plate fixed to the swing arm and the means to actuate said swing is a pneumatic cylinder secured to and fixedly carried by the dispensing apparatus.

20. A cover-dispensing apparatus, as in claim 19, in which the swinging arm has one end carried by a shaft pivotally carried in bearing means secured in bearing supports affixed to the apparatus and whose other end is mounted and carried by a pin means and a clevis means on one end of the cycled cylinder and whose other end is carried by a support and is pivotally connected to means in said support.

21. A cover-dispensing apparatus, as in claim 20, in which the vacuum to the cups is provided only as and when the lowermost cover is grasped by the cups and the jaws are in open position to provide escapement and release of the cover, and vacuum is continued until said cover is brought to or nearly to the guideway whereat the vacuum is cut off.

22. A cover-dispensing apparatus, as in claim 1, in which the guideway is at a determined slope and the metering of the serially-advanced covers is by a rod end that is cycled so that said rod end is disposed to enter that space between adjacent covers and, when inhibiting is to be effected, this rod end is caused to enter said space and come in way of that next-above cover to be advanced and applied to a container.

23. A cover-dispensing apparatus, as in claim 22, in which the rod end providing the inhibiting action is a portion of a rod pivotally carried by a supported shaft.

24. A cover-dispensing apparatus, as in claim 23, in which the cover-pressing means includes a freely-turning roller carried on an arm pivotally carried on said support shaft, said arm and roller lifted by an advancing container and cover and moved toward a cover-pressing condition and position by a spring means and with a limit stop provided so as to prevent movement of the roller beyond a defined limit below an advanced cover.

25. A cover-dispensing apparatus, as in claim 24, in which there is provided a lost-motion actuation between the roller supporting arm and the metering rod member so that the downwardly extending rod end is brought to an inhibiting position in way of the succeeding cover while the roller is lifted to press the forward cover in place and said rod end is lifted from this inhibiting condition when and while the roller is moved downwardly by the spring when no container is at the cover-applying position.

26. A cover-dispensing apparatus, as in claim 25, in which there is provided a rigid upstanding support and clamp means that engages and utilizes this support to adjust the height of the support shaft above the guideway, and there is provided means for moving the roller and arm to a position so as to substantially traverse a center line of the cover as it is pressed into position on the container.

27. A cover-dispensing apparatus, as in claim 1, in which the covers are automatically fed and delivered to the dispensing apparatus, this automatic-feed apparatus including a walking-beam mechanism and a plurality of guide rails adapted to receive and retain a multiplicity of like advanced covers arrayed in a more-or-less vertical manner and normal to the travel path of the walking beam, said guide rails having terminating ends that are curved to produce a ninety-degree turn so as to guide and deliver the advanced covers from a vertical position to a horizontal and stacked condition.

28. A cover-dispensing apparatus, as in claim 1, in which the gravity delivery chute also includes cover-rotating means so that covers having spout means therein are rotated and brought to an orientated desired position before positioning and pressing the cover on the upper rim of a container.

29. A cover-dispensing apparatus, as in claim 28, in which the cover-rotating means includes three free-turning rollers arrayed at one side of the guideway so as to engage a side of an advancing cover and a central roller of these three being carried on a spring-loaded bracket or support and disposed to be moved toward and away from the side of the guideway, and on the opposite side of the guideway is disposed a driven roller, also disposed to engage the side of and rotate said advancing cover, this driven roller carried on a supported arm that is disposed to be pivotally moved so that the driven roller is moved to and away from the side of an advanced cover, this movement of the arm being in timed relationship by an actuating means.

30. A cover-dispensing apparatus, as in claim 29, in which the actuating means moving the pivoted arm carrying the driven roller is a pneumatic cylinder.

31. A cover-dispensing apparatus, as in claim 30, in which there is also magnet means for moving and bringing to an upright condition and position a pivotally-mounted bail or handle, said upright condition established after cover application, and with guide rails disposed to maintain the bail or handle in said upright position during further advancement of the container.

32. A cover-dispensing apparatus, as in claim 1, in which the guideway is provided with means for dividing the gravity flow of dispensed covers into at least two streams and, after division, feeding each stream in guideways whose width is such that covers are slideably guided in single-file array, with the metering of the serially-advanced covers in each guideway having a rod end that is cycled so that said rod end is disposed to enter that space between adjacent covers and, when inhibiting is to be effected, this rod end is caused to enter said space and come in way of that next-above cover to be advanced and applied to a container.

33. A cover-dispensing apparatus, as in claim 32, in which the rod end in each guideway and providing the inhibiting action is a portion of a rod pivotally carried by a support shaft.

34. A cover-dispensing apparatus, as in claim 33, in which each guideway has a cover-pressing means which includes a freely-turning roller carried on an arm pivotally carried on said support shaft, said arm and roller lifted by an advancing container and cover and moved toward a cover-pressing condition and position by a spring means and with a limit stop provided so as to prevent movement of the roller beyond a defined limit below an advanced cover.

35. A cover-dispensing apparatus, as in claim 1, in which there is provided mechanism for lifting and lowering the dispensing apparatus and at a selected adjusted height to clamp the mechanism against unwanted movement of the apparatus.

36. A cover-dispensing apparatus, as in claim 35, in which the lifting-and-lowering mechanism includes a fixed spine member carried within a movable tubular member providing a support for the dispensing apparatus, this spine member fixedly secured to an outer guide member which supports and slideably guides the moveable tubular support member as it is moved, said outer guide member having securing means for retaining this outer guide member to a support frame, this lifting-and-lowering mechanism including a rotatable shaft and a handwheel for rotating said shaft, and a cable or flexible wire wrapped to provide a plurality of turns around and in engagement with said shaft; an upper end of this cable or wire secured to the spine and a lower end of this cable or wire secured to a spring-actuated member so as to keep the cable or wire taut as and while wound around the shaft.

37. A cover-dispensing apparatus, as in claim 36, in which the lifting-and-lowering mechanism and the clamp therefor include a friction shoe adapted to be pressed against the spine member and with said friction shoe carried by a U-shaped member actuated and carried by a screw secured and movable in and out in thread means provided in a wall portion of the tubular support member.

38. A method for cover dispensing in which covers are received and arranged in stacked array and then separated and delivered, one at a time, to a gravity chute or guideway and, at a metering and cover-applying station, the foremost cover is positioned and pressed on a top rim of a traveling container, said dispensing method including the steps of:

(a) receiving a multiplicity of covers in a stacked array and with guide means positioning said covers in way of separating and escapement means;

(b) arranging at least three pairs of jaws in a radial pattern and disposing said pairs so that a first set of jaws is moved and movable toward and away from a lowermost first cover and providing a support means for a lower rim of said first cover of the stack, and when said jaws are moved away from said first cover, providing escapement of this first cover;

(c) arranging a second set of clamp jaws and moving said second set of jaws toward and away from an above second cover and in timed relationship and concert with the movement of the first set of jaws, this movement alternately providing a clamp and engagement support of the above second cover while the first cover is being released and releasing said second cover after the first cover has been removed from in way of the first set of jaws and the first jaws to a cover-support position and condition;

(d) carrying a plurality of vacuum cups on an arm and swinging this arm and means for actuating the flow of vacuum to and from said cups in timed relationship with the swing of said arm so that the cups grasp the lowermost first cover and move this cover to a delivery position, after which the vacuum is cut off;

(e) supplying and arranging a gravity chute or guideway so as to receive the dispensed covers, one at a time, and in a single thickness array and carrying said covers to a metering station;

(f) metering said dispensed covers on said chute or guideway so that means comes in way of advanced covers to inhibit the progress of a succeeding cover from proceeding to an applying station until the foremost cover has been placed on a traveling container, and (g) positioning and pressing said foremost cover at a cover-applying station by progressively pressing said foremost cover from its leading edge to its trailing edge to and the upper rim of a container while actuating the metering means to prevent undue and unwanted advancement of a succeeding cover.

39. A method for cover-dispensing, as in claim 38, which includes positioning and retaining the first and second set of jaws so as to be in the same plane and moving these jaws between spaced, fixed support and upper-ring plates and actuating said jaws so as to be moved in and out by a reciprocated outer ring member.

40. A method for cover-dispensing, as in claim 39, which further includes providing and positioning damping means for diminishing the back-and-forth stop shock produced by the reciprocated and actuated movement of the outer ring.

41. A method for cover-dispensing, as in claim 40, which further includes providing and positioning additional upper and lower adjusting rings, each ring individually moved and movable in a circular path to position the jaw members at a particular cover diameter and with each jaw member having means in cooperation with an adjusting ring to move the jaw member to a predetermined cover diameter.

42. A method for cover-dispensing, as in claim 41, which further includes providing and positioning releaseable clamps for both the upper and lower adjusting rings and with manipulation providing release of these rings for adjustment, after which the clamps are tightened for dispensing of covers from the apparatus.

43. A method for cover-dispensing, as in claim 42, which further includes providing secured and mounted pins in each of the jaws and guide supports and with each of said pins engaging the sides of slots formed in the adjusting ring and with said pin and slot, when the adjusting ring is moved clockwise or counterclockwise, moving the pin and the limit of movement of the jaw members and guide bars to establish the diameter of the cover, the upper ring controlling the adjusted position for those pins in those jaw members disposed to control escapement release and support of the lowermost cover and also for the pin used with each guide member, and a tightening of this clamp moving the top adjusting ring into frictional immobility against the fixed upper ring plate; the lower adjusting ring controlling the adjusted position of those pins for the jaw members disposed to control the clamp, support and escapement of the immediately-above cover from the lowermost cover, and a tightening of this clamp moving the bottom adjusting ring into frictional immobility against the fixed lower support plate.

44. A method for cover-dispensing, as in claim 39, which further includes forming the face ends of those jaws members providing the escapement of the above or second cover with a replaceable arcuate face portion secured to a shank portion, this replaceable face portion having a contour sized and adapted to clamp and support said second cover while the first or lowermost cover is being withdrawn.

45. A method for cover-dispensing, as in claim 44, which further includes forming the face portions of the jaws so as to engage those metal covers having scalloped side portions and with apertures formed in each scallop therewith and providing potential means for the scallops of adjacent stacked covers to partially enter and provide an interference fit in said apertures forming said assembled jaw face portion with a thin, plate-like metal portion in which an unsupported arcuate portion is slit to provide a multiplicity of extending fingers, some of which are disposed to enter formed apertures in the scallops in the side portions of the first cover and displacing a partially-seated scallop, and with the rest of those fingers, not entering an aperture, deflected downardly toward the guideway and toward and to a downwardly-curved support also secured to the jaw and moved therewith.

46. A method for cover-dispensing, as in claim 38, which includes arranging and disposing said guideway at a determined slope and metering of the serially-advanced covers by a rod end that is cycled so that said rod end is disposed to enter that space between adjacent covers and, when inhibiting is to be effected, causing this rod end to enter said space and come in way of that next-above cover to be advanced and applied to a container.

47. A method for cover-dispensing, as in claim 46, which further includes providing on the cover-pressing means a freely-turning roller carried on an arm pivotally carried on a support shaft and lifting said arm and roller by an advancing container and cover, said roller moved toward a cover-pressing condition and position by a spring means and providing a limit stop so as to prevent movement of the roller beyond a defined limit below an advanced cover; and further including and providing a lost-motion actuation between the roller supporting arm and the metering rod member so that the downwardly-extending rod end is brought to an inhibiting position in way of the succeeding cover while the roller is lifted to press the forward cover in place, and lifting said rod end from this inhibiting condition when and while the roller is moved downwardly by the spring when no container is at the cover-applying position.

48. A method for cover-dispensing, as in claim 38, which includes automatically feeding and delivering an array of covers to the dispensing apparatus, this automatic feeding apparatus having a walking-beam mechanism and a plurality of guide rails adapted to receive and retain a multiplicity of like advanced covers arrayed in a more-or-less vertical manner and normal to the travel path of the walking beam, said guide rails having terminating ends that are curved to produce a ninety-degree turn so as to guide and deliver the advanced covers from a vertical position to a horizontal and stacked condition.

49. A method for cover-dispensing, as in claim 38, which includes mounting and arranging in said gravity delivery chute, cover-rotating means so that covers having spout means therein are rotated and brought to an orientated desired position before positioning and pressing the cover on the upper rim of a container, and arraying three free-turning rollers at one side of the guideway so as to engage a side of an advancing cover and with a central roller of these three being carried on a spring-loaded bracket or support and disposing said central roller to be moved toward and away from the side of the guideway, and on the opposite side of the guideway disposing a driven roller so as to engage the side of and rotate said advancing cover, the driven roller carried on a supported arm that is pivotally moved so that the driven roller is moved to and away from the side of an advanced cover, this movement of the arm being in a timed relationship by an actuating means.

50. A method for cover-dispensing, as in claim 49, which further includes magnet means for moving and bringing to an upright condition and position a pivotally-mounted bail or handle, said upright condition established after cover application, and disposing guide rails so as to maintain the bail or handle in said upright position during further advancement of the container.

51. A method for cover-dispensing, as in claim 38, in which there is provided the step of providing adjusting means for lifting and lowering the dispensing apparatus and selecting an adjusted height whereby a clamp means is tightened, said adjusting means so as to clamp the dispensing apparatus at the desired height and against unwanted movement.

52. A method for cover-dispensing, as in claim 51, which further includes carrying a fixed spine member within a moveable tubular member and providing a support therewith for the dispensing apparatus, and securing this spine member fixedly to an outer guide member which supports and slideably guides the movable tubular support member as it is moved, and providing said outer guide member with securing means for retaining this outer guide member to a support frame, this lifting-and-lowering mechanism including a rotatable shaft and a handwheel for rotating said shaft, and a cable or flexible wire wrapped to provide a plurality of turns around and in engagement with said shaft; securing an upper end of this cable or wire to the spine and with a lower end of this cable or wire secured to a spring-actuated member so as to keep the cable or wire taut as and while wound around the shaft.

53. A cover-dispensing apparatus adapted to receive covers and, in a stacked array, separate and deliver a cover, one at a time, to a gravity chute or guideway whereby and at a metering and at an applying station the forwardmost cover is positioned and pressed on a top rim of a traveling container, said dispensing apparatus including:

(a) guide means for receiving a multiplicity of covers in a stacked array and positioning said covers in way of separating and dispensing means;

(b) a plurality of at least three pairs of upper and lower pivotally-swung jaw arms, said upper jaw arms moved clockwise and counterclockwise by an upper reciprocated actuating ring carried by a fixed support ring, the movement of the upper reciprocated ring by a controlled actuating signal and means, the lower jaw arms moved clockwise and counterclockwise by a lower reciprocated actuating ring also carried by said fixed support ring, the movement of the lower reciprocated ring in timed response to a controlled actuating signal and means, the lower jaw-arm members moved and movable toward and away from the lowermost first cover to provide support means in way of a lower rim of said first cover and, when said jaw arms are moved away from said rim, escapement of said first cover is provided, after which the actuated ring is again moved to bring the jaw arms to a cover-support position;

(c) means for moving the upper actuating ring includes a timing actuation to provide coincident movement of the upper jaw arms so that the face portions thereof are moved toward and away from a second cover, and alternately providing a clamp and engagement of this above second cover while the first cover is released and to release said second cover after the first cover has been moved from in way of the first set of jaw arms, both upper and lower jaw arms having face portions contoured so as to accept and retain the peripheral portions of said covers pivotally retained by a shaft;

(d) a plurality of vacuum cups carried on and by a swinging arm and means to actuate said vacuum and the movement of said swinging arm so as to grasp by said vacuum cups the first cover as it is released by the first jaw arms and move said first cover to a delivery position;

(e) a gravity chute or guideway adapted to receive the released covers, one at a time, and in a single thickness array, carry said covers to a metering station;

(f) metering means adapted to come in way of advancing covers and to inhibit the proceeding of a following cover to a cover-applying station until a forwardmost cover has been placed on a traveling or advancing container, and (g) positioning and pressing means at said cover-applying station, with a cover-applying means progressively pressing a cover from a leading to a trailing edge to and onto an upper rim of a container while actuating the metering means to prevent undue advancement of a succeeding cover.

54. A cover-dispensing apparatus, as in claim 53, in which each pair of upper and lower jaw arms is pivotally carried on a common shaft.

55. A cover-dispensing apparatus, as in claim 54, in which each of the shafts has a screw-adjusting means by which the upper jaw arm may be raised or lowered to accommodate the thickness and contour of the covers being dispensed.

56. A cover-dispensing apparatus, as in claim 55, in which the face portions of the jaw arms are made with replaceable face portions contoured to accept and retain the covers at their peripheries.

57. A cover-dispensing apparatus, as in claim 53, in which the upper actuating ring is adjustably moved and secured by means to the fixed support ring, this adjusting movement establishing the support and escapement of the jaw arms for the cover above the lowermost cover and the lower actuating ring is adjustably moved and secured by means to the fixed support ring, this adjusting movement establishing the support and escapement of the jaw arms for the lowermost cover.

58. A cover-dispensing apparatus, as in claim 57, in which the actuation of the upper reciprocated ring and the actuation of the lower reciprocated ring is by pneumatic cylinders, with one cylinder disposed and actuated for each ring.

59. A cover-dispensing apparatus, as in claim 58, in which the fixed support ring is carried by a base plate and this base plate is formed with apertures for receiving boss portions of the support ring, said boss portions rotatably carrying a shaft which provides a common pivot support for one pair of the jaw arms.

60. A cover-dispensing apparatus, as in claim 53, in which each jaw arm has an extending leg that is carried and slides in a slot in a socket member secured to and rotatable on an actuated reciprocated actuating ring.

61. A cover-dispensing apparatus, as in claim 59, in which there is a plurality of roller guides for retaining and guiding the upper and lower reciprocated actuating ring.

* * * * *